US009164470B2

(12) United States Patent
Sakashita et al.

(10) Patent No.: US 9,164,470 B2
(45) Date of Patent: Oct. 20, 2015

(54) TRANSFER DEVICE AND ATTACHMENT OF THE TRANSFER DEVICE TO A COVER OF AN IMAGE FORMING APPARATUS

(71) Applicants: Takeshi Sakashita, Hyogo (JP); Masanari Fujita, Osaka (JP); Mitsutoshi Kichise, Osaka (JP); Tetsushi Sakuma, Osaka (JP)

(72) Inventors: Takeshi Sakashita, Hyogo (JP); Masanari Fujita, Osaka (JP); Mitsutoshi Kichise, Osaka (JP); Tetsushi Sakuma, Osaka (JP)

(73) Assignee: RICOH COMPANY, LIMITED, Tokyo (JP)

( * ) Notice: Subject to any disclaimer, the term of this patent is extended or adjusted under 35 U.S.C. 154(b) by 32 days.

(21) Appl. No.: 14/025,017

(22) Filed: Sep. 12, 2013

(65) Prior Publication Data

US 2014/0079434 A1 Mar. 20, 2014

(30) Foreign Application Priority Data

Sep. 18, 2012 (JP) ..... 2012-203910
Nov. 30, 2012 (JP) ..... 2012-263431

(51) Int. Cl.
*G03G 15/16* (2006.01)
*G03G 21/16* (2006.01)

(52) U.S. Cl.
CPC ..... *G03G 21/1623* (2013.01); *G03G 15/16* (2013.01); *G03G 21/1633* (2013.01)

(58) Field of Classification Search
USPC ..... 399/121
See application file for complete search history.

(56) References Cited

U.S. PATENT DOCUMENTS

| | | | |
|---|---|---|---|
| 2007/0110458 | A1 | 5/2007 | Inoue et al. |
| 2007/0183816 | A1 | 8/2007 | Hatayama et al. |
| 2007/0269233 | A1 | 11/2007 | Sakashita et al. |
| 2008/0003022 | A1 | 1/2008 | Sakashita et al. |
| 2008/0028967 | A1 | 2/2008 | Sakashita et al. |
| 2008/0050158 | A1 | 2/2008 | Hatayama et al. |
| 2008/0138133 | A1 | 6/2008 | Hatayama et al. |
| 2008/0187365 | A1 | 8/2008 | Sakashita et al. |
| 2008/0193167 | A1 | 8/2008 | Inoue et al. |
| 2008/0193173 | A1 | 8/2008 | Meguro et al. |
| 2008/0317521 | A1 | 12/2008 | Inoue et al. |

(Continued)

FOREIGN PATENT DOCUMENTS

| | | |
|---|---|---|
| JP | 62-209546 | 9/1987 |
| JP | 08-030054 | 2/1996 |

(Continued)

OTHER PUBLICATIONS

U.S. Appl. No. 13/924,923, filed Jun. 24, 2013, Tetsushi Sakuma, et al.

(Continued)

*Primary Examiner* — Quana M Grainger
(74) *Attorney, Agent, or Firm* — Oblon, McClelland, Maier & Neustadt, L.L.P.

(57) ABSTRACT

An image forming apparatus, includes: a main body; a cover configured to be provided so as to be capable of being opened and closed with respect to the main body; an attachment unit configured to be provided on the cover; a unit configured to be attached to the attachment unit; a positioning member configured to, on closing of the cover, position the unit with respect to a member attached to the main body or the main body; a guiding member configured to guide the unit to the positioning member; and a protrusion configured to be provided at the guiding member to protrude in an attaching direction of the unit.

21 Claims, 21 Drawing Sheets

(56) References Cited

U.S. PATENT DOCUMENTS

| | | | | |
|---|---|---|---|---|
| 2009/0011882 | A1 | 1/2009 | Kichise et al. | |
| 2009/0014288 | A1 | 1/2009 | Miyazaki et al. | |
| 2009/0016772 | A1 | 1/2009 | Adachi et al. | |
| 2009/0022514 | A1* | 1/2009 | Fujiwara et al. | 399/121 |
| 2009/0129831 | A1 | 5/2009 | Sakashita et al. | |
| 2009/0285594 | A1 | 11/2009 | Kichise et al. | |
| 2010/0239334 | A1 | 9/2010 | Iwami et al. | |
| 2011/0110685 | A1* | 5/2011 | Sato et al. | 399/121 |
| 2012/0237268 | A1 | 9/2012 | Sakashita et al. | |
| 2013/0011158 | A1 | 1/2013 | Meguro et al. | |
| 2013/0051854 | A1* | 2/2013 | Sakuma et al. | 399/121 |
| 2013/0108320 | A1* | 5/2013 | Ju et al. | 399/121 |

FOREIGN PATENT DOCUMENTS

| | | |
|---|---|---|
| JP | 08-166731 | 6/1996 |
| JP | 2005-172856 | 6/2005 |
| JP | 2006-259449 | 9/2006 |
| JP | 2009-139436 | 6/2009 |
| JP | 2009-282062 | 12/2009 |
| JP | 2009-294357 | 12/2009 |
| JP | 2011-085867 | 4/2011 |

OTHER PUBLICATIONS

U.S. Appl. No. 13/924,923, filed Jun. 24, 2013.

* cited by examiner

TRANSFER DEVICE AND ATTACHMENT OF THE TRANSFER DEVICE TO A COVER OF AN IMAGE FORMING APPARATUS

CROSS-REFERENCE TO RELATED APPLICATIONS

The present application claims priority to and incorporates by reference the entire contents of Japanese Patent Application No. 2012-203910 filed in Japan on Sep. 18, 2012 and Japanese Patent Application No. 2012-263431 filed in Japan on Nov. 30, 2012.

BACKGROUND OF THE INVENTION

1. Field of the Invention

The present invention relates to a transfer device and an image forming apparatus.

2. Description of the Related Art

For example, there are known electrophotographic image forming apparatuses in which a secondary transfer unit is attached to a cover of a main body to allow easy handling of a paper jam occurring between a secondary transfer roller and an opposed roller or neighboring parts thereof (see Japanese Patent Application Laid-open No. 2006-259449, Japanese Patent Application Laid-open No. 2009-139436, and Japanese Patent Application Laid-open No. 2011-85867). In this case, when the cover is opened, the secondary transfer roller can be separated from the opposed roller, thereby to facilitate removal of jammed paper.

In some of image forming apparatuses having a secondary transfer unit attached to a cover as described above, the secondary transfer unit is configured to be easy for a user or the like to replace for further improved maintenance properties.

However, on replacement of the secondary transfer unit, when the cover is closed while the secondary transfer unit is imperfectly attached to the cover, the secondary transfer roller may not be correctly positioned, thereby exerting influence on image formation and the like after the replacement. In addition, when the secondary transfer unit is not correctly positioned at closing of the cover, the components may be broken.

The problem of improper attachment of the unit to the cover may also arise in units other than the secondary transfer unit.

Accordingly, in light of the foregoing circumstances, there is needed to provide an image forming apparatus that allows suppression of occurrence of improper attachment of the unit.

SUMMARY OF THE INVENTION

It is an object of the present invention to at least partially solve the problems in the conventional technology.

According to the present invention, there is provided: an image forming apparatus comprising: a main body; a cover configured to be provided so as to be capable of being opened and closed with respect to the main body; an attachment unit configured to be provided on the cover; a unit configured to be attached to the attachment unit; a positioning member configured to, on closing of the cover, position the unit with respect to a member attached to the main body or the main body; a guiding member configured to guide the unit to the positioning member; and a protrusion configured to be provided at the guiding member to protrude in an attaching direction of the unit.

The present invention also provides an image forming apparatus comprising: a main body including a frame; a cover including a hole and configured to be opened and closed with respect to the main body; a transfer roller supporter including a pin and configured to support a transfer roller and to be attached to the cover by inserting the pin into the hole in an attaching direction; a groove provided on the frame and configured to, on closing of the cover, position a shaft of the transfer roller with respect to the frame; a guide provided on the frame and configured to guide the shaft of the transfer roller to the groove; and a protrusion provided on the guide and protruding in the attaching direction.

The present invention also provides a transfer device comprising: a transfer unit configured to transfer an image to a recording medium; a transfer entrance guide configured to be switchable between a guiding position at which to guide the recording medium to the transfer unit and an evacuation position being relatively evacuated from the guiding position; a supporting member that supports the transfer entrance guide in a displaceable manner; a guide positioning member configured to guide the transfer entrance guide at the guiding position; and a guide guiding member configured to guide the transfer entrance guide to the guide positioning member, wherein the transfer device further comprises a guiding auxiliary member, when the transfer entrance guide is guided to the guide positioning member along the guide guiding member, abuts an abutment member of the transfer entrance guide and presses the transfer entrance guide in a guiding direction toward the guide positioning member.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
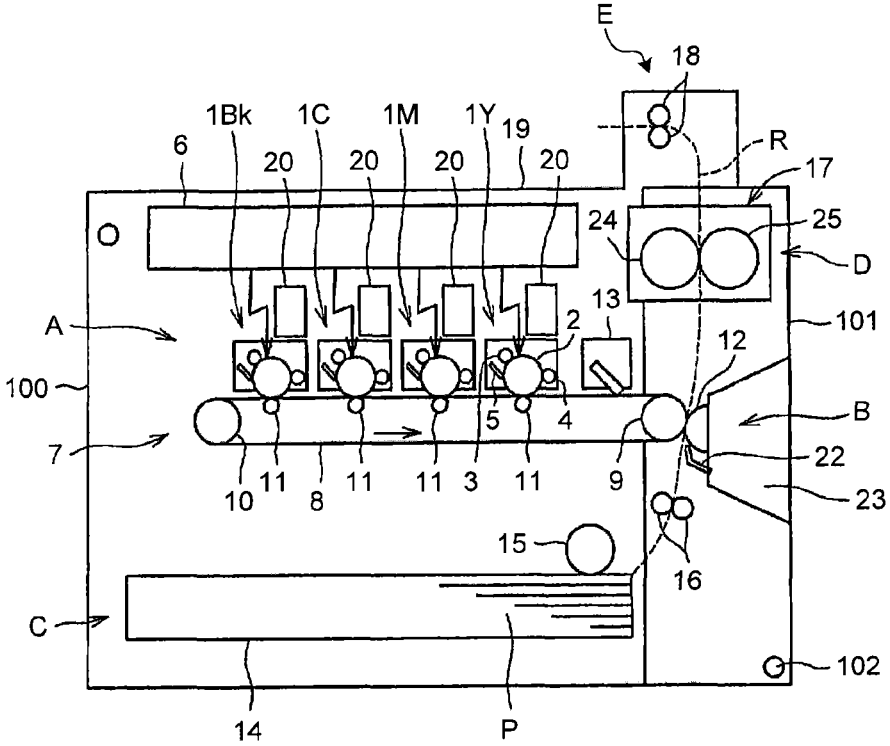
FIG. 1 is a schematic configuration view of a color laser printer as an image forming apparatus according to one embodiment of the present invention.

Embodiments of the present invention will be described below with reference to the attached drawings. Throughout the respective drawings, constitutional elements such as members and components with the same functions or shapes will be given the same reference numerals as much as possible, and these elements will be described only once.

First Embodiment

FIG. 1 is a schematic configuration view of a color laser printer as an image forming apparatus according to one embodiment of the present invention. First, referring to FIG. 1, an entire configuration and operations of the color laser printer will be described.

As illustrated in FIG. 1, an image forming apparatus of the embodiment includes an image forming section A that forms an image; a transfer section B that transfers an image to a paper as a recording medium; a paper feeding section C that feeds papers to the transfer section B; a fixing section D that fixes the transferred image on the paper; and a discharging section E that discharges the paper to the outside of the device. In FIG. 1, a route indicated by a dotted line refers to a conveying path R for conveying the paper from the paper feeding section C to the discharging section E.

Attached to the image forming section A are four process units 1Y, 1M, 1C, and 1Bk as image forming units that form images of different colors, yellow (Y), magenta (M), cyan (C), and black (Bk) corresponding to color separation elements of color images, so as to be detachable from an image forming apparatus main body 100. Each of the process units 1Y, 1M, 1C, and 1Bk includes a drum-shaped photosensitive element 2 as a latent image carrier (image carrier) carrying a latent image on a surface thereof; a roller charging device 3 as charging unit that charges a surface of the photosensitive element 2; a developing roller 4 as a developing unit that converts the latent image on the photosensitive element 2 into a visible image; and a cleaning blade 5 as a cleaning unit for cleaning the surface of the photosensitive element 2.

In FIG. 1, reference numerals are given to only the photosensitive element 2, the roller charging device 3, the developing roller 4, and the cleaning blade 5 included in the process unit 1Y for yellow images, and no reference numerals are given to those in the other process units 1M, 1C, and 1Bk.

In FIG. 1, toner hoppers 20 are provided above the respective process units 1Y, 1M, 1C, and 1Bk such that toner is supplied from the respective toner hoppers 20 to the respective process units 1Y, 1M, 1C, and 1Bk.

Arranged above the respective toner hoppers 20 is an exposing device 6 as a latent image forming unit that forms electrostatic latent images on the surfaces of the respective photosensitive elements 2. The exposing device 6 is configured to have a light source, a polygon mirror, an f-θ lens, a reflecting mirror, and the like, and radiate laser light onto the surfaces of the photosensitive elements 2 on the basis of image data.

The transfer section B is provided with a transfer device 7 as a transfer unit that transfers toner images to the paper as a recording medium. The transfer device 7 includes an endless intermediate transfer belt 8 as an intermediate transfer element, four primary transfer rollers 11 as primary transfer members, a secondary transfer roller (a transfer roller) 12 as a secondary transfer member, and a transfer entrance guide 22.

The intermediate transfer belt 8 is extended by a driving roller 9 and a driven roller 10. The driving roller 9 is rotated and driven by a drive source not illustrated. When the driving roller 9 rotates counterclockwise in the drawing, the intermediate transfer belt 8 goes round (rotates) in the direction of arrow in the drawing. A belt cleaning device 13 is on the outer peripheral of the intermediate transfer belt 8 at the right end side of the drawing arranged to clean the surface of the intermediate transfer belt 8.

The four primary transfer rollers 11 are in abutment with the photosensitive elements 2 via the intermediate transfer belt 8, respectively. Accordingly, the respective photosensitive elements 2 and the intermediate transfer belt 8 are in contact with each other to form primary transfer units (primary transfer nips) for transferring toner images between these components. The primary transfer rollers 11 are each connected to a power supply not illustrated to apply a predetermined direct-current voltage (DC) and/or an alternating-current voltage (AC) to the primary transfer rollers 11.

The secondary transfer roller 12 is in abutment with the driving roller 9 via the intermediate transfer belt 8. This forms a secondary transfer unit (secondary transfer nip) for transferring a toner image between the secondary transfer roller 12 and the intermediate transfer belt 8. As with the primary transfer rollers 11, the secondary transfer roller 12 is connected to the power supply not illustrated to apply a predetermined direct-current voltage (DC) and/or an alternating-current voltage (AC) to the secondary transfer roller 12.

The transfer entrance guide 22 is arranged near the secondary transfer unit on the upstream side in the direction of paper conveyance. The transfer entrance guide 22 guides papers to the secondary transfer unit. In addition, the transfer entrance guide 22 and the secondary transfer roller 12 are supported by a supporting member 23 provided on the cover 101 of the image forming apparatus main body 100.

The paper feeding section C is provided with a paper feed tray 14 storing paper P, a paper feeding roller 15 feeding the paper P from the paper feed tray 14, and the like. A pair of registration rollers 16 is arranged as timing rollers in the conveying path R between the paper feeding roller 15 and the secondary transfer roller 12. The paper P includes thick paper, postcards, envelopes, normal paper, thin paper, coated paper (coat paper, art paper, and the like), tracing paper, and the like. In addition, OHP sheets, OHP films, and the like may be used as recording media.

The fusing section D is provided with a fixing device 17 for fixing a non-fixed image transferred to the paper. The fixing device 17 includes therein a fixing roller 24 having a heating source not illustrated, and a pressing roller 25 pressed by the fixing roller 24. Fixing nips are formed at places where the both rollers 24 and 25 are in abutment with each other.

The discharging section E is provided with a pair of discharging rollers 18 for discharging papers to the outside of the device and a discharge tray 19 for stocking papers discharged to the outside of the device.

Subsequently, basic operations of the printer according to the embodiment will be described with reference to FIG. 1.

When an image forming operation is started, the respective photosensitive elements 2 of the respective process units 1Y, 1M, 10, and 1Bk are rotated and driven clockwise in the drawing by a driving device not illustrated, the surfaces of the respective photosensitive elements 2 are evenly charged with a predetermined polarity by the roller charging device 3. Based on image information of an original read by a reading device not illustrated, the exposing device 6 radiates laser light onto the charging surfaces of the respective photosensitive elements 2 to form electrostatic latent images on the surfaces of the photosensitive elements 2. At that time, the image information exposed to the respective photosensitive elements 2 are single-color image information in which a desired full-color image is separated into color information of yellow, magenta, cyan, and black. The respective developing rollers 4 supply toner to the electrostatic latent images formed on the photosensitive elements 2 to convert the electrostatic latent images into visible images (rendering) as toner images.

In addition, when an image forming operation is started, the driving roller 9 over which the intermediate transfer belt 8 extends is rotated and driven to cause the intermediate transfer belt 8 to go round in the direction of arrow in the drawing. Then, when a constant voltage or a voltage subjected to constant current control with a polarity opposite to the charging polarity of the toner is applied to the respective primary transfer rollers 11, transfer electric fields are formed at primary transfer units between the respective primary transfer rollers 11 and the respective photosensitive elements 2.

After that, when the toner images of respective colors on the photosensitive elements 2 have reached the first transfer units with rotation of the respective photosensitive elements 2, the toner images on the photosensitive elements 2 are sequentially transferred in an overlapped manner onto the intermediate transfer belt 8 by the transfer electric fields formed at the primary transfer units. Accordingly, a full-color toner image is carried on the surface of the intermediate transfer belt 8. In addition, the toner on the respective photosensitive elements 2 not transferred to the intermediate transfer belt 8 is eliminated by the cleaning blade 5.

At the paper feeding section C, the rotation and driving of the paper feeding roller 15 are started to send out the paper P from the paper feed tray 14 into the conveying path R. The paper P sent out into the conveying path R is temporarily stopped by the registration roller 16.

After that, the rotation and driving of the registration roller 16 is started at a predetermined timing, and the paper P is conveyed to the secondary transfer unit in a manner timed with the timing at which the toner images on the intermediate transfer belt 8 reaches the secondary transfer unit. At that time, a transfer voltage with a polarity opposite to the toner charging polarity of the toner images on the intermediate transfer belt 8 is applied to the secondary transfer roller 12, thereby to form a transfer electrical field at the secondary transfer unit. Then, the toner images on the intermediate transfer belt 8 are collectively transferred onto the paper P by the transfer electrical field. The residual toner on the intermediate transfer belt 8 not transferred onto the paper P is removed by the belt cleaning device 13.

After that, the paper P is conveyed to the fixing device 17. At the fixing device 17, the paper P passes through the fixing nip formed between the fixing roller 24 and the pressing roller 25 to fix the toner image to the paper P. Then, the paper P is discharged by the discharging roller 18 to the outside of the device and is stocked on the discharge tray 19.

The foregoing description is given as to the image forming operation for forming a full-color image on the paper. Alternatively, any one of the four process units 1Y, 1M, 1C, and 1Bk may be used to form a single-color image, or two or three process units may be used to form a two- or three-color image.

Figure 2:
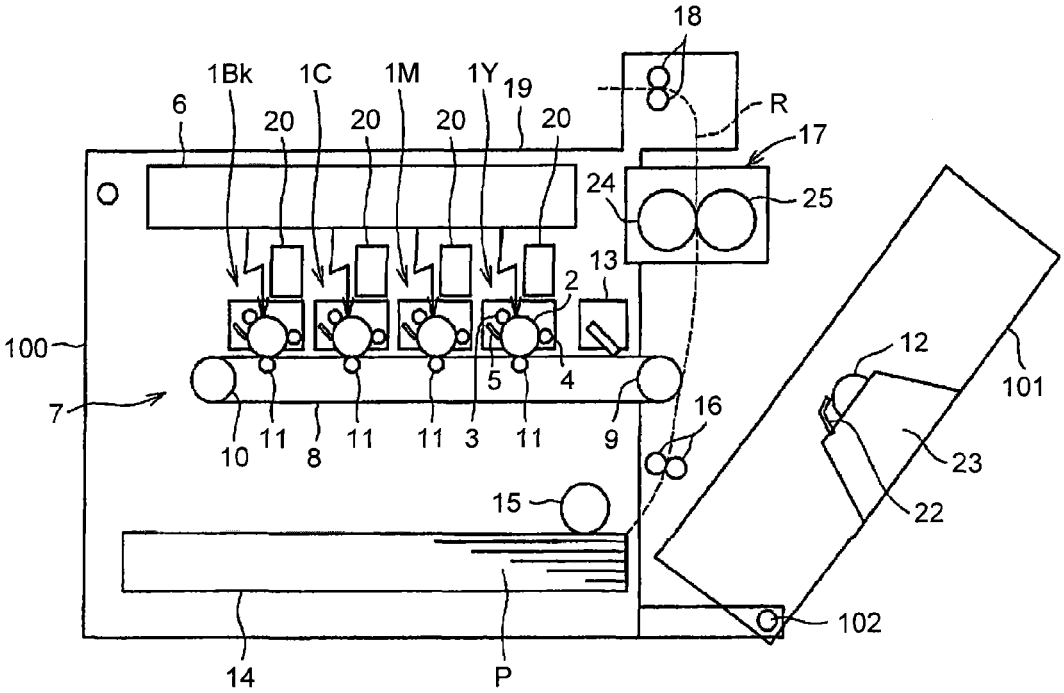
FIG. 2 is a view illustrating the printer with the cover opened.

As illustrated in FIGS. 1 and 2, in the embodiment, the cover 101 provided at the front unit of the image forming apparatus main body 100 is configured to be swingable around a fulcrum 102 provided at the lower unit of the cover 101. In addition, since the secondary transfer roller 12 and the transfer entrance guide 22 are attached to the cover 101 via the supporting member 23 as described above, the secondary transfer roller 12 and the transfer entrance guide 22 move together with opening or closing of the cover 101. Specifically, with opening or closing of the cover 101, the secondary transfer roller 12 is switched between a transfer position in contact with the intermediate transfer belt 8 and an evacuation position evacuated relatively from the transfer position. In addition, with opening or closing of the cover 101, the transfer entrance guide 22 is switched between a guide position to guide papers to the secondary transfer unit and an evacuation position evacuated relatively from the guide position.

According to the foregoing configuration, even if a paper jam occurs in the conveying path R, the front side of the image forming apparatus main body 100 can be opened by swinging the cover 101 forward to remove the jammed paper in an easy manner. Besides the secondary transfer roller 12 and the transfer entrance guide 22, the fixing device 17, the registration roller 16, and the discharging roller 18 may also move together with the cover 101.

Figure 3:
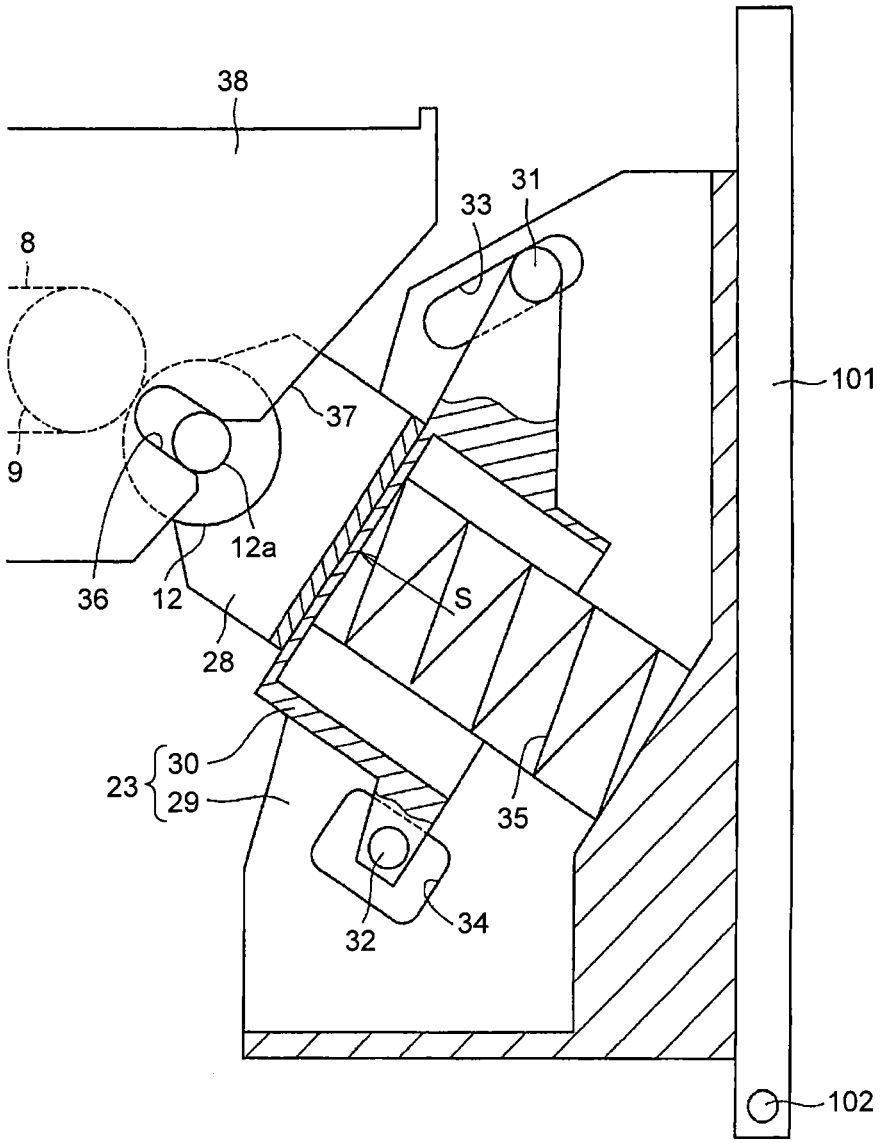
FIG. 3 is a view illustrating a support structure and a positioning structure for a secondary transfer roller.

FIG. 3 is a view illustrating a support structure and a positioning structure for the secondary transfer roller 12.

As illustrated in FIG. 3, the secondary transfer roller 12 is rotatably held by a holding member 28. The holding member 28 is supported by the supporting member 23 provided at the cover 101. Specifically, the supporting member 23 of the embodiment includes a fixed supporting member 29 fixed to the inner surface of the cover 101 and a movable supporting member 30 movable with respect to the fixed supporting member 29. The holding member 28 is attached to the movable supporting member 30.

The movable supporting member 30 is supported via two movable supporting members 31 and 32 so as to be displaceable with respect to the fixed supporting member 29. The supporting members 31 and 32 are members such as bosses provided at the movable supporting member 30, which are movably inserted into hole units 33 and 34 formed at the fixed supporting member 29, respectively. When the respective supporting members 31 and 32 move in the hole units 33 and 34, the movable supporting member 30 is movable with respect to the fixed supporting member 29. Accordingly, the secondary transfer roller 12 and the holding member 28 are displaced in the direction of moving closer to or away from the cover 101.

Pressing spring 35 is provided as an elastic member between the movable supporting member 30 and the fixed supporting member 29. The movable supporting member 30 and the secondary transfer roller 12 supported by the movable supporting member 30 are biased by pressing force S of the pressing spring 35 in the direction of separating from the cover 101 (the direction of arrow S in the drawing). In the embodiment, the pressing spring 35 is a compression coil spring. Alternatively, an extension coil spring or a torsion coil spring may be used to bias the movable supporting member 30 in the same manner as described above.

Provided on the image forming apparatus main body side are a concave positioning member (a groove) 36 for positioning the secondary transfer roller 12 and a guiding member (a guide) 37 for guiding the secondary transfer roller 12 to the positioning member 36. As illustrated in FIG. 3, a rotating shaft (a shaft) 12*a* of the secondary transfer roller 12 is fitted into the positioning member 36 by a biasing force of the pressing spring 35, and then the secondary transfer roller 12 is brought into abutment with the driving roller 9 as an opposed member to position the secondary transfer roller 12.

Figure 4:
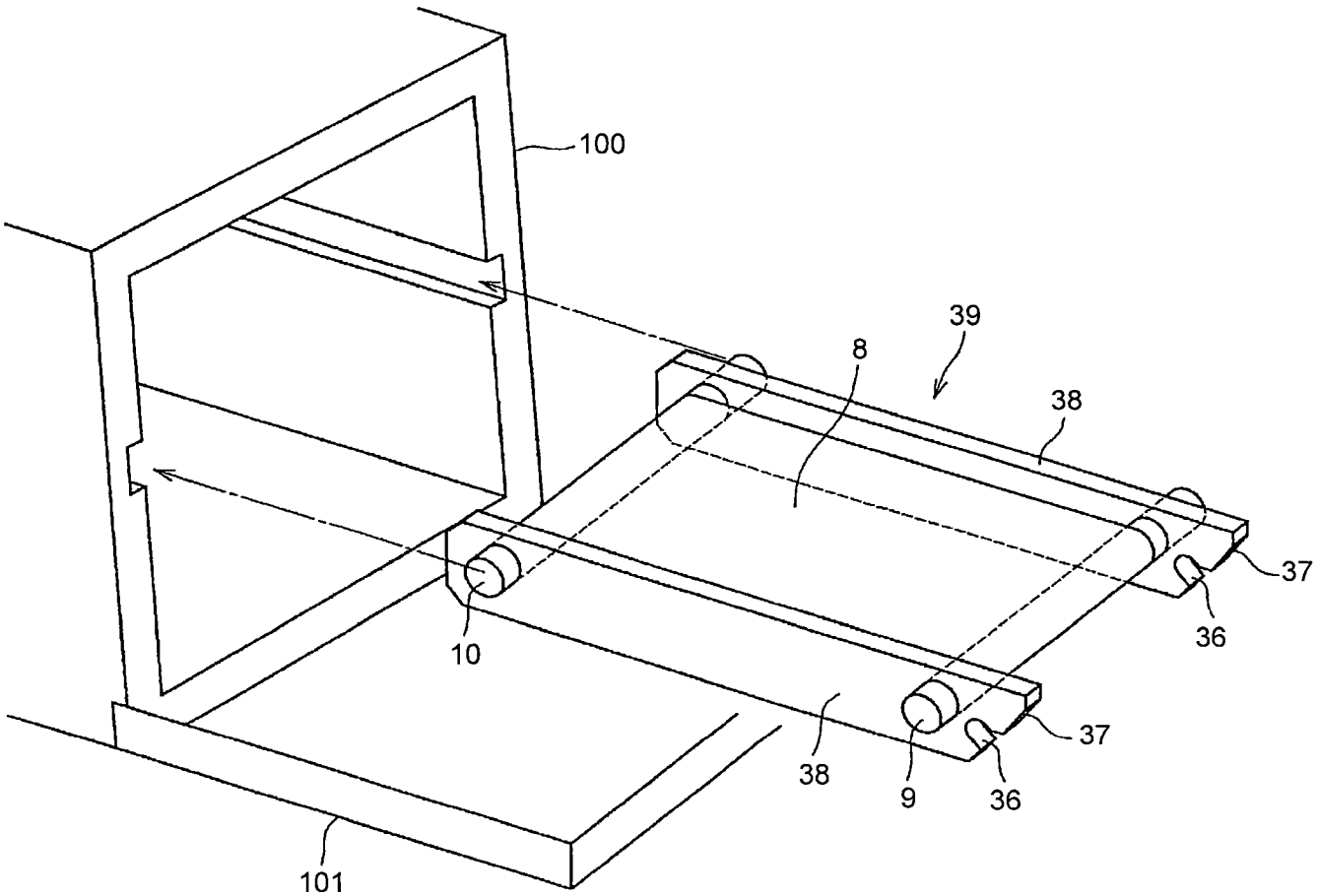
FIG. 4 is a view illustrating the printer with an intermediate transfer unit removed.

As illustrated in FIG. 4, in the embodiment, the positioning members 36 and the guiding members 37 are provided at a pair of supporting frames (frames) 38 of an intermediate transfer unit 39. The pair of supporting frames 38 supports rotatably the driving roller 9 and the driven roller 10 over which the intermediate transfer belt 8 is extended. The intermediate transfer unit 39 is configured to be attachable to and detachable from the image forming apparatus main body 100. When the intermediate transfer unit 39 is attached to the image forming apparatus main body 100, the positioning member 36 and the guiding member 37 are located at functional positions. Providing the supporting frames 38 of the intermediate transfer unit 39 with the functions of the positioning member 36 and the guiding member 37 as in the embodiment, makes it possible to achieve downsizing and low costs of the device. Alternatively, the main body 100 may be provided with a separate member having the functions of the positioning member 36 and the guiding member 37. Otherwise, the main body 100, specifically, the frame or the like of the main body 100 may be provided with a member having the functions of the positioning member 36 and the guiding member 37.

In the embodiment, the secondary transfer roller 12 and the holding member 28 are configured as an integrated secondary transfer unit in a manner detachable from the movable supporting member 30.

Figure 5:
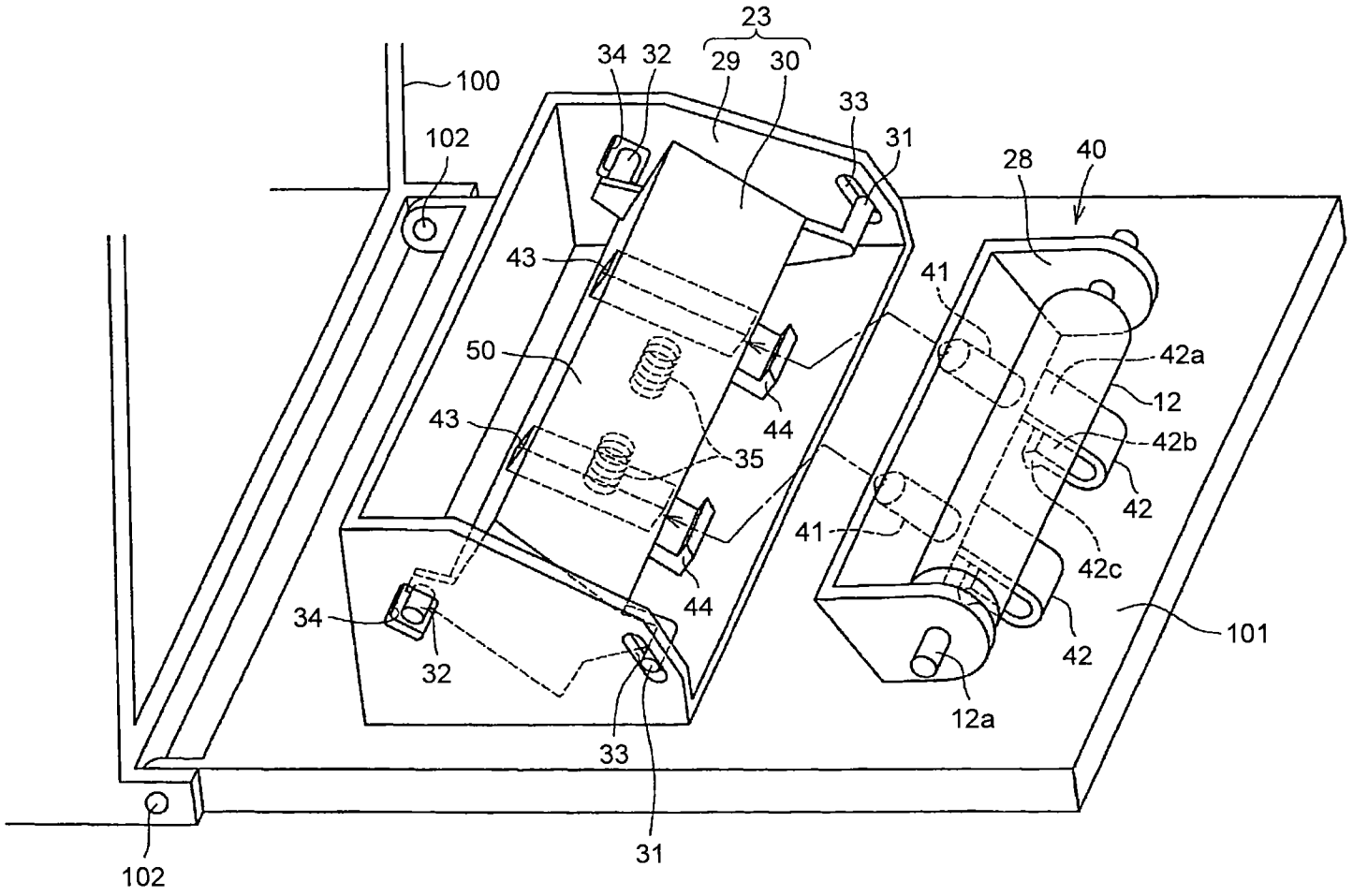
FIG. 5 is a view illustrating the printer with a secondary transfer unit detached.
Figure 6:
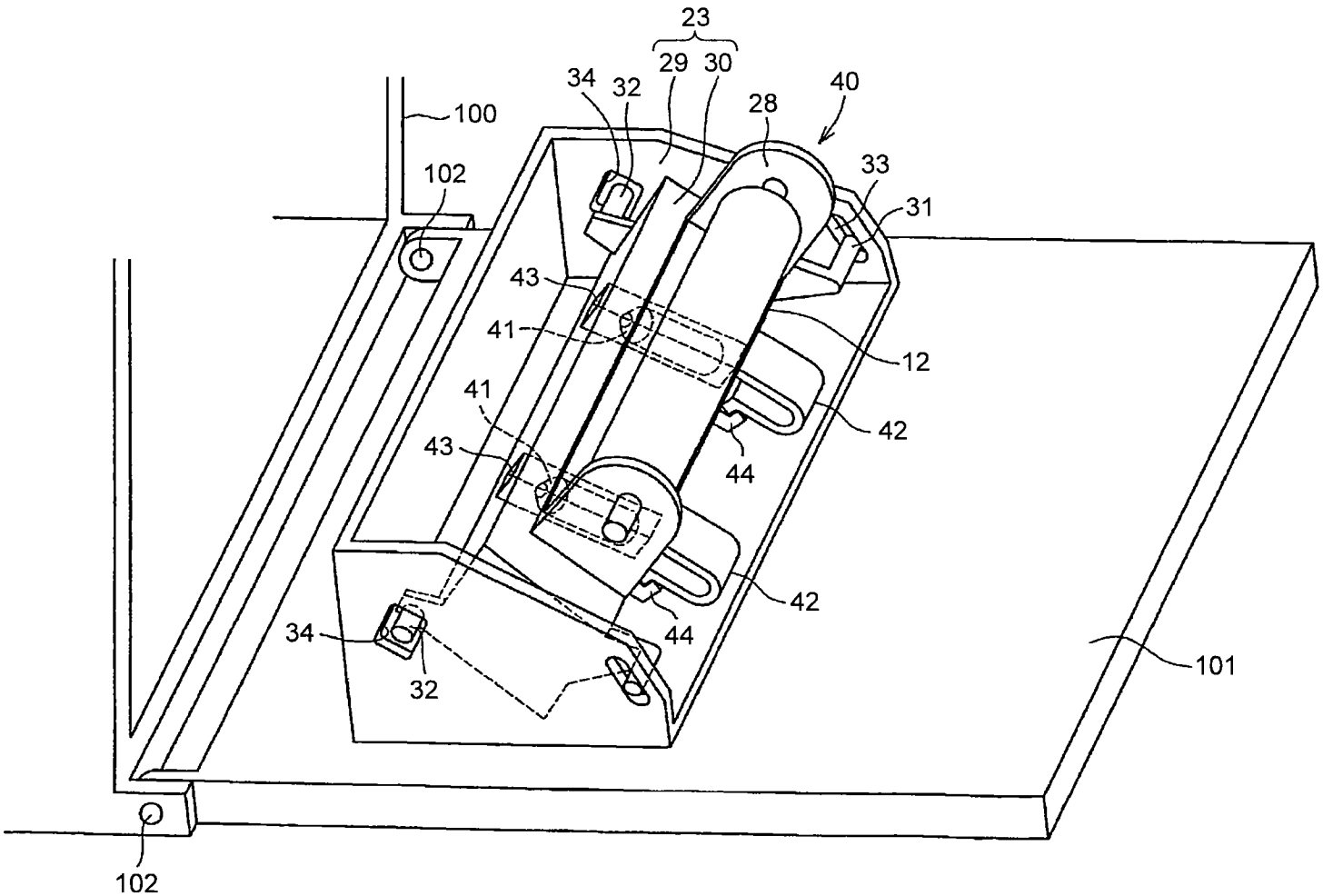
FIG. 6 is a view illustrating the printer with the secondary transfer unit attached.

FIG. 5 is a view illustrating the device with the secondary transfer unit (a transfer roller supporter) 40 detached from the movable supporting member 30, and FIG. 6 is a view illustrating the device with the secondary transfer unit 40 attached to the movable supporting member 30.

Specifically, the secondary transfer unit 40 includes a pair of insertion members (pins) 41 and a pair of lock members 42 as means for attachment to the movable supporting member 30. Each of the insertion members 41 is formed by a pin-shaped member. A plurality of (two in FIG. 5) insertion members 41 is provided in parallel along the longitudinal side of the holding member 28 (in the axial direction of the secondary transfer roller 12). Each of the lock members 42 is formed by a U-shaped elastic member. One end 42*a* of the lock member 42 is a fixed end fixed to the holding member 28 and the other end 42*b* is a free end. The free end 42*b* of the lock member 42 includes a claw 42*c*. As with the insertion members 41, a plurality of (two in FIG. 5) lock members 42 is provided in parallel along the longitudinal side of the holding member 28 (in the axial direction of the secondary transfer roller 12).

Meanwhile, an attachment unit 50 of the movable supporting member 30 includes a pair of insertion holes (holes) 43 into which the insertion members 41 are inserted and a pair of hooks 44 on which the claws 42*c* of the lock members 42 are hooked.

Figure 7:
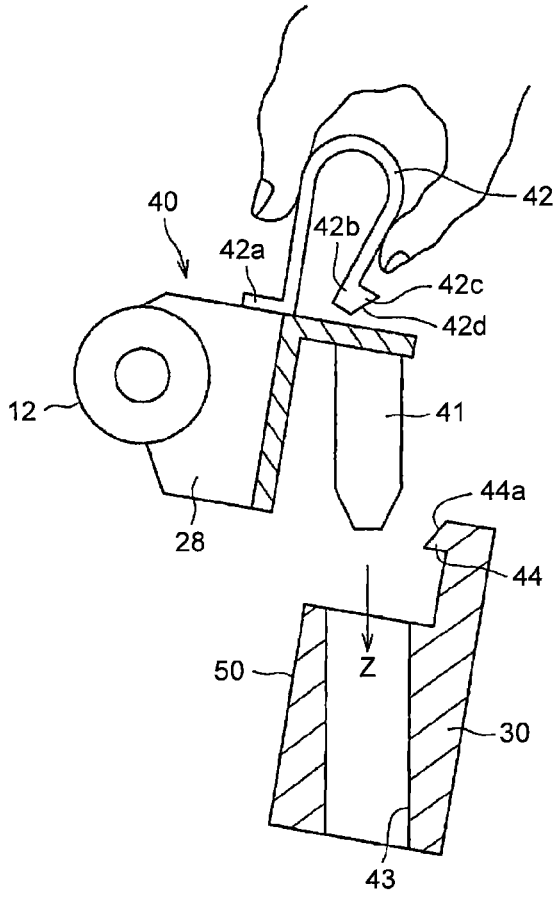
FIG. 7 is a view for describing a method for attaching the secondary transfer unit.

Next, a method for attaching the secondary transfer unit 40 will be described with reference to FIGS. 7 and 8.

When the secondary transfer unit 40 is attached to the movable supporting member 30, the lock members 42 are picked up and elastically deformed by fingers such that the free end 42*b* comes closer to the fixed end 42*a*. Then, in that state, the insertion member 41 is inserted into the insertion hole 43 of the movable supporting member 30.

Figure 8:
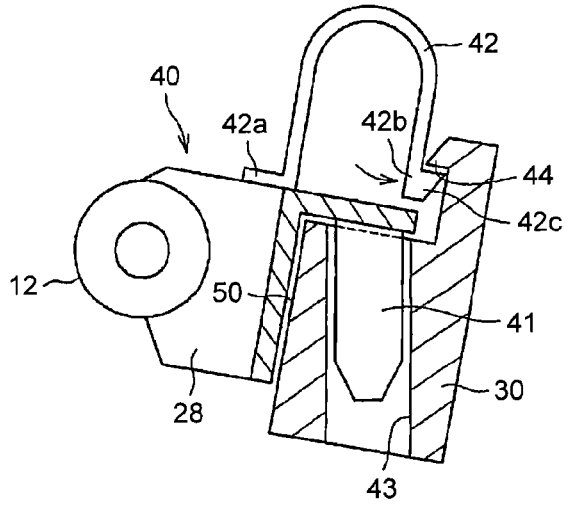
FIG. 8 is a view for describing a method for attaching the secondary transfer unit.

As illustrated in FIG. 8, while the insertion member 41 is inserted into prescribed positions in the insertion hole 43, when the lock member 42 is released, the free end 42*b* is separated from the fixed end 42*a* by an elastic restoring force. Accordingly, the claw 42*c* is hooked on the hook 44 to lock the secondary transfer unit 40 on the movable supporting member 30.

Alternatively, the secondary transfer unit 40 may be pressed into the movable supporting member 30 without elastically deforming the lock member 42 by fingers to attach the secondary transfer unit 40. Specifically, when the claw 42*c* of the lock member 42 comes into abutment with the hook 44, the lock member 42 is elastically deformed by a pressing force, whereby the claw 42*c* can be locked over the hook 44. In addition, as illustrated in FIG. 7, respective leading end surface 42*d* and 44*a* of the claw 42*c* and the hook 44 may be tapered to be inclined with respect to attaching direction Z of the secondary transfer unit 40 (or inserting direction of the insertion member 41), which allow the claw 42*c* to come over the hook 44 in an easy manner.

To remove the secondary transfer unit 40 from the movable supporting member 30, the free end 42*b* of the lock member 42 is elastically deformed by fingers so as to come closer to the fixed end 42*a* to release the lock, and then the secondary transfer unit 40 is pulled out.

Figure 9:
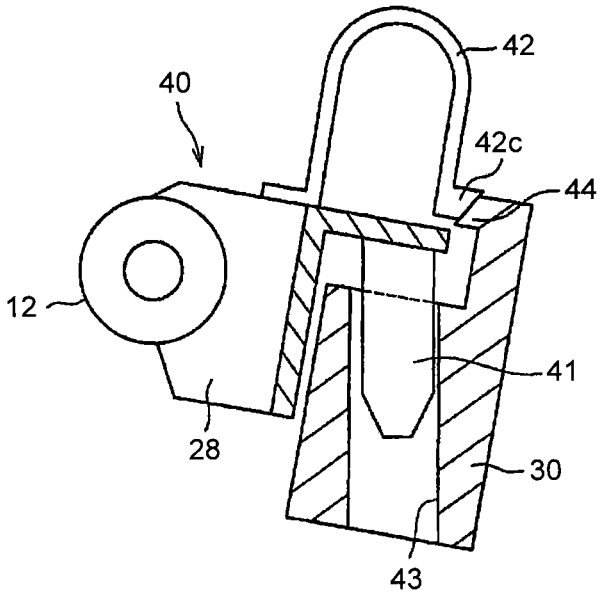
FIG. 9 is a view illustrating the secondary transfer unit improperly attached.

In the embodiment, it is conceivable that the cover 101 is closed while the secondary transfer unit 40 is improperly attached (the claw 42*c* is not locked on the hook 44), as illustrated in FIG. 9. In such a case, conventionally, this state may affect image formation or cause breakage of components. Accordingly, to solve the problem with improper attachment of the unit, the image forming apparatus according to the present invention is configured in the manner described below.

Figure 10:
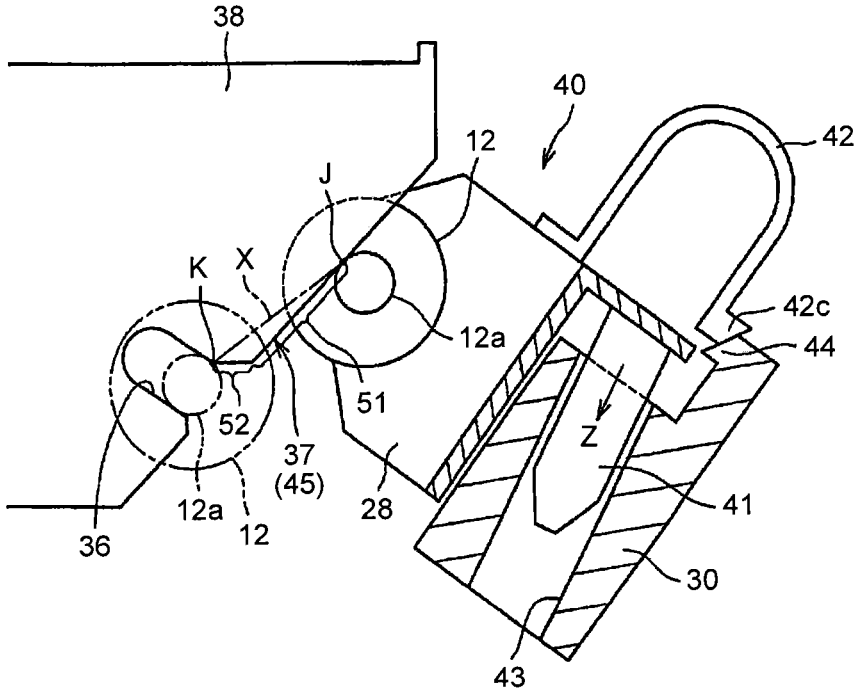
FIG. 10 is a view illustrating the secondary transfer roller in abutment with a guiding member.

FIG. 10 is a view illustrating the secondary transfer roller 12 in abutment with the guiding member 37.

As illustrated in FIG. 10, when the cover 101 is closed, the rotating shaft 12*a* of the secondary transfer roller 12 abuts the guiding member 37 and moves along the guiding member 37, thereby to guide the secondary transfer roller 12 to the positioning member 36. In this arrangement, when it is assumed that a virtual line connecting a start point J at which the rotating shaft 12*a* starts to abut the guiding member 37 and an end point K at which the rotating shaft 12*a* reaches the positioning member 36 is designated as X, the guiding member 37 includes a protrusion 45 protruding in the attaching direction Z of the secondary transfer unit 40 beyond the virtual line X. Accordingly, it is possible to provide the secondary transfer unit 40 with a force in the direction of attachment to the attachment unit 50, as compared to the case without the protrusion 45. Therefore, the secondary transfer unit 40 can be easily attached to the attachment unit 50 together with closing of the cover 101, which makes it possible to suppress improper attachment of the secondary transfer unit 40.

The protrusion 45 includes a first guide surface 51 that is provided upstream of the direction of guiding the rotating shaft 12*a* to the positioning member 36, and a second guide surface 52 that is provided downstream of the first guide surface 51 and is set at an angle different from that of the first guide surface 51.

Figure 11:
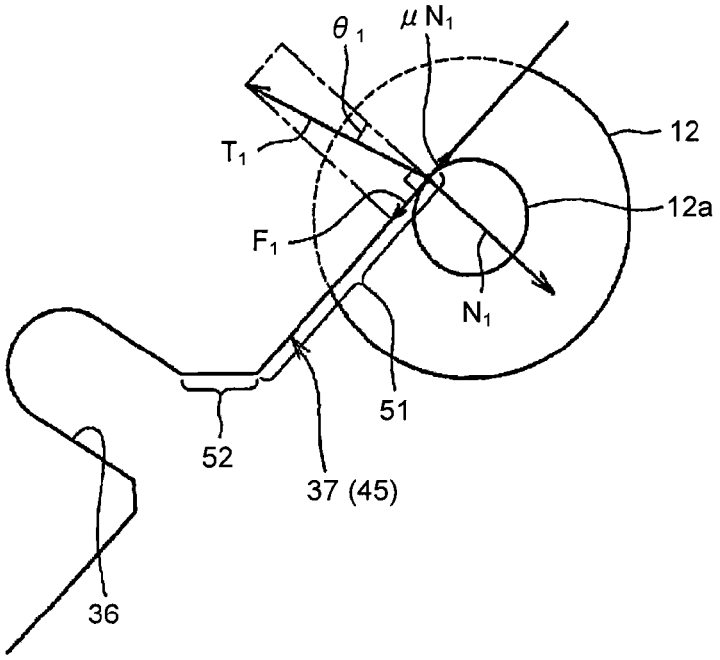
FIG. 11 is a view illustrating the relationships among forces generated on a rotating shaft in abutment with a first guide surface.

FIG. 11 is a view illustrating the relationships among forces generated on the rotating shaft 12*a* in abutment with the first guide surface 51.

As illustrated in FIG. 11, when the rotating shaft 12*a* of the secondary transfer roller 12 abuts the first guide surface 51 under the pressing force S of the pressing spring 35, abutment force $T_1$ acts on the first guide surface 51. The abutment force $T_1$ acts in a direction inclined at angle $\theta_1$ toward the positioning member 36 with respect to the direction orthogonal to the first guide surface 51. Accordingly, force $F_1$ as a guide surface parallel component of the abutment force $T_1$ ($T_1 \sin \theta_1$) acts on the rotating shaft 12*a*, and the secondary transfer roller 12 under the force $F_1$ moves toward the positioning member 36.

In addition, friction force $\mu N_1$ opposite in direction to the force $F_1$ in the direction toward the positioning member 36 acts on the rotating shaft 12*a*. The friction force $\mu N_1$ is expressed by the product of friction coefficient $\mu$ and reaction force $N_1$ acting on the rotating shaft 12*a*. The reaction force $N_1$ is a force identical in magnitude to a guide surface orthogonal component of the abutment force $T_1$ ($T_1 \cos \theta_1$) and opposite in direction to the same.

Figure 12:
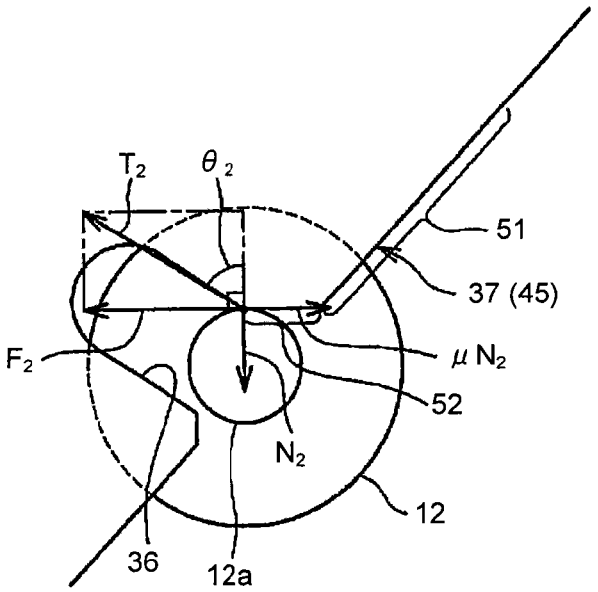
FIG. 12 is a view illustrating the relationships among forces generated on the rotating shaft in abutment with a second guide surface.

FIG. 12 is a view illustrating the relationships among forces generated on the rotating shaft 12*a* in abutment with the second guide surface 52.

In this case, the a variety of forces are different in direction and magnitude from those illustrated in FIG. 11, but the kinds of the forces acting on the rotating shaft 12*a* are basically identical to those illustrated in FIG. 11. Therefore, when the rotating shaft 12*a* is in abutment with the second guide surface 52, force $F_2$ toward the positioning member 36 and friction force $\mu N_2$ act on the rotating shaft 12*a*. FIG. 12 illustrates elements $T_2$, $\theta_2$, $F_2$, and $N_2$ corresponding to $T_1$, $\theta_1$, $F_1$, and $N_1$, respectively.

As described in the foregoing, when the rotating shaft 12*a* is in abutment with the respective guide surfaces 51 and 52, the forces $F_1$ and $F_2$ act on the rotating shaft 12*a* in the direction toward the positioning member 36. In the embodiment, the forces $F_1$ and $F_2$ are made larger than the friction forces $\mu N_1$ and $\mu N_2$. Specifically, the force $F_1$ and $F_2$ toward the positioning member 36 are adjusted by setting the angles of the respective guide surfaces 51 and 52 and the direction of the pressing force of the pressing spring 35. When it is assumed that the abutment force with which the rotating shaft 12*a* is in abutment with the first guide surface 51 or the second guide surface 52 is designated as T, the angle formed by the direction of the abutment force T and the direction orthogonal to the guide surface as $\theta$, the force toward the positioning member 36 as F, the reaction force as N, and the friction coefficient between the secondary transfer roller 12 and the guide surface as $\mu$, the condition expressed in Equation (2) obtained from the relationship expressed in Equation (1) needs to be met as follows:

$$F-\mu N=T \sin \theta-\mu T \cos \theta>0 \quad (1)$$

$$\tan \theta>\mu \quad (2)$$

According to Equation (2), for example, when the friction coefficient $\mu$ between the rotating shaft 12*a* formed by applying nickel plating to the surface of an iron shaft and the resin guiding unit 37 is 0.2 to 0.3, the angle $\theta$ needs to be 16.7° or more.

When the condition in Equation (2) is met, the force F toward the positioning member 36 becomes larger than the friction force $\mu N$, which makes it easier to guide the secondary transfer roller 12 to the positioning member 36. In addition, the secondary transfer unit 40 can be attached by the force F toward the positioning member 36. This matter will be described below in detail.

Figure 13:
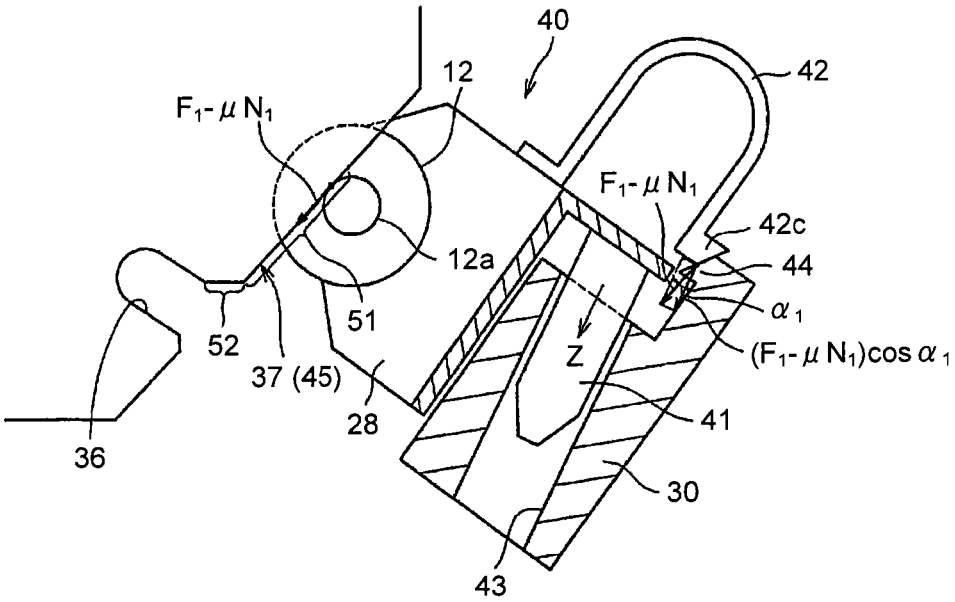
FIG. 13 is a view illustrating a force generated on a lock member when the rotating shaft is in abutment with the first guide surface.

As illustrated in FIG. 13, when the rotating shaft 12*a* of the secondary transfer roller 12 abuts with the first guide surface 51 with closing of the cover 101, the force $F_1$ toward the positioning member 36 acts on the rotating shaft 12*a* as described above. However, the friction force $\mu N_1$ opposite in direction to the force $F_1$ also acts on the rotating shaft 12*a*, and thus a differential force between these forces ($F_1-\mu N_1$) becomes a moving force with which the secondary transfer roller 12 is moved toward the positioning member 36.

The moving force ($F_1-\mu N_1$) contributes to attachment of the secondary transfer unit 40. Specifically, of the moving force ($F_1-\mu N_1$), a component parallel to the attaching direction Z of the secondary transfer unit 40 contributes to attachment of the secondary transfer unit 40 as a force moving the secondary transfer unit 40 in the attaching direction Z. When it is assumed that the angle formed by the direction of the moving force ($F_1-\mu N_1$) and the attaching direction Z as $\alpha_1$, the component parallel to the attaching direction Z is ($F_1-\mu N_1$) $\cos \alpha_1$.

As described in the foregoing, the force generated upon the abutment of the rotating shaft 12*a* with the first guide surface 51 acts as a force for moving the secondary transfer unit 40 in the attaching direction Z. At that time, the force for moving the unit 40 in the attaching direction Z becomes equal to or more than a force needed for the claws 42*c* to come over the hooks 44, the claws 42*c* are locked over the hooks 44, which makes it possible to attach completely the secondary transfer unit 40.

Further, the embodiment is configured in such a manner that, as the rotating shaft 12*a* is guided toward the positioning member 36, the force for moving the secondary transfer unit 40 in the attaching direction Z increases.

Figure 14:
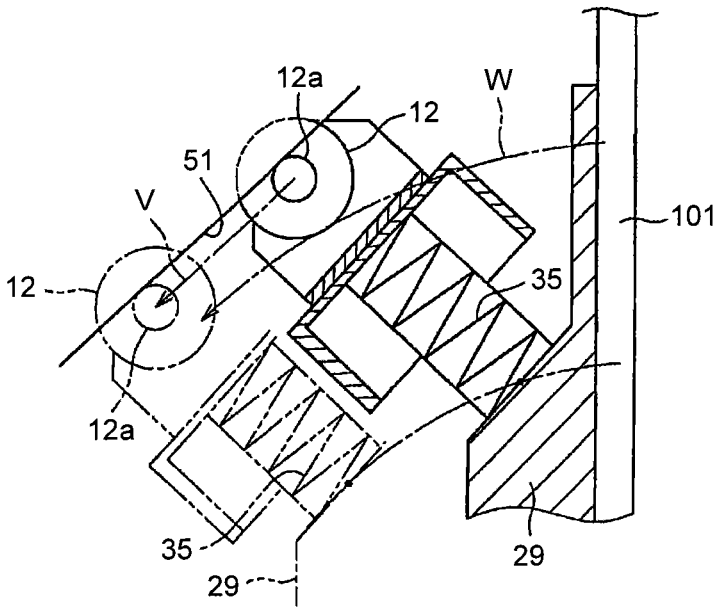
FIG. 14 is a view illustrating the relationship between a movement locus of the rotating shaft and a movement locus of the cover.

Specifically, as illustrated in FIG. 14, the embodiment is configured in such a manner that movement locus V of the rotating shaft 12*a* (unit abutment member) abutting the first guide surface 51 and guided to the positioning member 36 and movement locus W of the cover 101 when being closed comes closer to each other in the direction of closing the cover 101. In the foregoing configuration, when the cover 101 is closed, the pressing spring 35 is compressed and thus the abutment force of the rotating shaft 12*a* with the first guide surface 51 becomes larger. Accordingly, the force for moving the unit 40 in the attaching direction Z increases.

Figure 15:
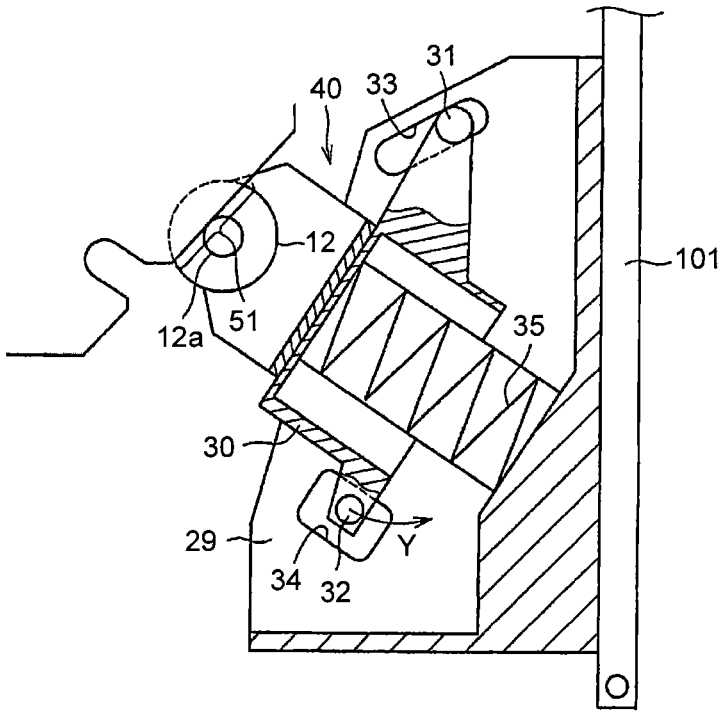
FIG. 15 is a view illustrating rotating action of a movable supporting member.

With the foregoing relationship between the movement loci V and W of the rotating shaft 12*a* and the cover 101, when the cover 101 is closed, the secondary transfer unit 40 is displaced to come closer to the cover 101. At that time, of the two supporting members 31 and 32 supporting the movable supporting member 30 illustrated in FIG. 15, the upper supporting member 31 abuts the inner surface of the hole unit 33 and is controlled in movement toward the cover 101. Meanwhile, the lower supporting member 32 corresponds to the hole unit 34 larger in size than the upper hole unit 33, the lower supporting member 32 is permitted to move toward the cover 101. Accordingly, the movable supporting member 30 rotates in the direction of arrow Y in the drawing around the controlled upper supporting member 31.

Figure 16:
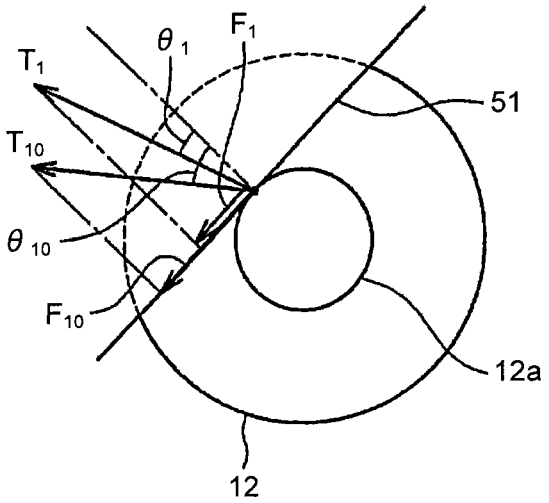
FIG. 16 is a view illustrating the direction of an abutment force varying with the rotating action of the movable supporting member.

As described in the foregoing, when the movable supporting member 30 rotates, the direction of the abutment force of the rotating shaft 12*a* changes accordingly from the direction indicated with $T_1$ to the direction indicated with $T_{10}$, as illustrated in FIG. 16. That is, the angle formed by the direction of the abutment force and the direction orthogonal to the first guide surface 51 increases from $\theta_1$ to $\theta_{10}$, and thus the force toward the positioning member 36 also increases from $F_1$ to $F_{10}$. As a result, the force for moving the unit 40 in the attaching direction Z also increases.

As in the foregoing, according to the embodiment, it is possible to increase effectively the force moving the secondary transfer unit 40 in the attaching direction Z by the increase of the pressing force due to the relationship between the movement loci V and W of the rotating shaft 12*a* and the cover 101 and the rotation of the movable supporting member 30. This facilitates the attachment of the secondary transfer unit 40 when the cover 101 is closed.

Even if, when the rotating shaft 12*a* is in abutment with the first guide surface 51, the force required for the claws 42*c* to come over the hooks 44 cannot be obtained, in the embodiment, the second guide surface 52 with a different angle is provided to assure the force required for the attachment.

Figure 17:
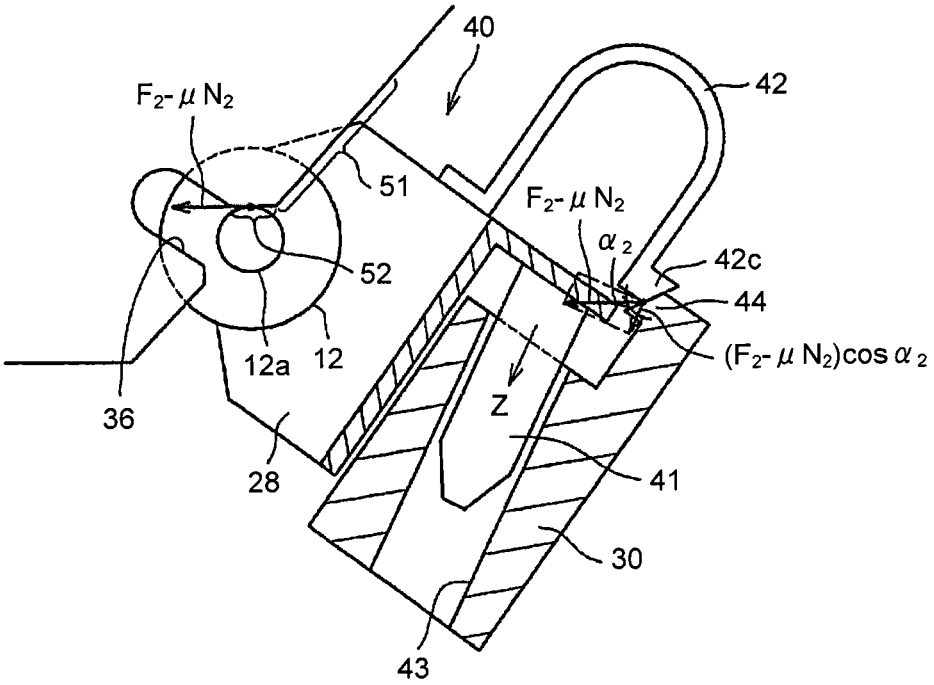
FIG. 17 is a view illustrating forces generated on the lock member when the rotating shaft abuts the second guide surface.

FIG. 17 is a view illustrating forces contributing to attachment of the secondary transfer unit 40 when the rotating shaft 12*a* abuts the second guide surface 52.

In this case, basically as in the foregoing case, a differential force $(F_2-\mu_2)$ between the force $F_2$ acting on the rotating shaft 12*a* in the direction toward the positioning member 36 and the friction force $\mu N_2$ acts on the secondary transfer unit 40. Therefore, a component $(F_2-\mu_2)\cos\alpha_2$ of the force parallel to the attaching direction Z becomes the force for moving the secondary transfer unit 40 in the attaching direction Z. In FIG. 17, the component parallel to the attaching direction Z is smaller than the component parallel to the attaching direction Z illustrated in FIG. 13. However, the component parallel to the attaching direction Z illustrated in FIG. 17 may be actually set larger according to the relationships with the angle of the second guide surface 52, the pressing force of the pressing spring 35, and the like.

Specifically, as illustrated in FIG. 12, when the rotating shaft 12*a* abuts the second guide surface 52, the angle of the second guide surface 52 is set such that the angle $\theta_2$ is larger than in the case where the rotating shaft 12*a* abuts the first guide surface 51 as illustrated in FIG. 11. Accordingly, when the rotating shaft 12*a* abuts the second guide surface 52, it is possible to obtain the large force $F_2$ in the direction toward the positioning member 36, thereby assuring the force needed for the claws 42*c* to come over the hooks 44.

As described in the foregoing, the secondary transfer unit 40 can be reliably attached by setting at least the second guide surface 52 at an angle at which a force acts on the secondary transfer unit 40 for attachment to the attachment unit when the secondary transfer unit 40 abuts the second guide surface 52.

In the foregoing, effects and operations of the first guide surface 51 and the second guide surface 52 are described in detail. However, either the first guide surface 51 or the second guide surface 52 may contribute to the attachment of the secondary transfer unit 40. In short, it is only needed that the guiding member 37 includes the protrusion 45 with which, when the cover 101 is closed, the secondary transfer unit 40 is pressed and attached in the attaching direction Z.

Figure 18:
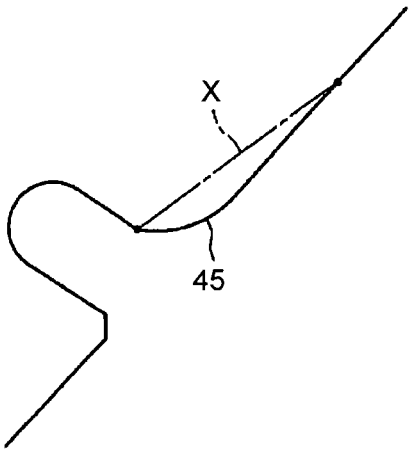
FIG. 18 is a view illustrating a modification example of a protrusion.

Therefore, the protrusion 45 may be provided across the entire guiding member 37 or at part of the guiding member 37. In addition, as illustrated in FIG. 18, the protrusion 45 may have a curved portion.

Figure 19:
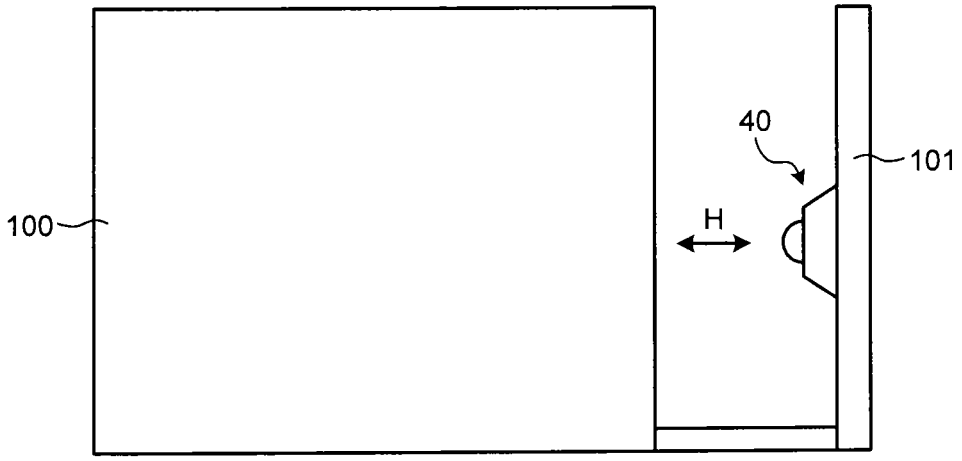
FIG. 19 is a view illustrating a configuration in which the cover is moved linearly to open or close the cover.

The present invention is not limited to the configuration in which the cover 101 is rotated for opening or closing as in the foregoing embodiment. The present invention may be applied to the configuration in which the cover 101 is moved linearly in horizontal direction H or the like for opening or closing as illustrated in FIG. 19. Further, in the foregoing embodiment, the cover 101 is closed to attach the secondary transfer unit 40. However, the present invention is not limited to this but may be applied to the case where the conveying unit including the registration roller or other detachable units is to be attached.

The system for image formation by the image forming apparatus to which the present invention is applied is not limited to the foregoing electrophotography. The present invention may be applied to devices of arbitrary image forming systems such as ink-jet system. In addition, the image forming apparatus is not limited to a printer but may be a copying machine, a facsimile, or a MFP including these devices.

As in the foregoing, according to the present invention, when the cover is closed, the unit can be moved effectively by the protrusion in the attaching direction. This makes it possible to attach the unit to the attachment unit with closing of the cover, thereby to suppress improper attachment of the unit. As a result, it is possible to avoid malfunction of the device and breakage of the components due to improper positioning of the unit.

In particular, a great advantage can be expected in the configuration of the present invention by applying the present invention to the configuration in which the attaching direction Z of the secondary transfer unit 40 is different from (or intersects with) the pressing direction S of the pressing spring 35 on positioning of the secondary transfer unit 40 as in the foregoing embodiment. In that configuration, it is generally hard to attach the unit to the attachment unit by closing the cover. However, the application of the present invention makes it possible to move the unit effectively in the attaching direction regardless of the relationship between the attaching direction and the pressing direction of the unit.

Second Embodiment

Figure 36:
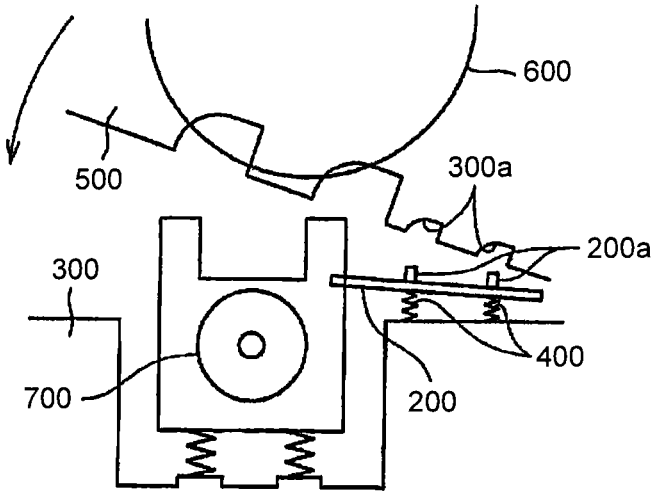
FIG. 36 is a view illustrating a configuration of a conventional transfer device.

For example, as illustrated in FIG. 36, Japanese Patent Application Laid-open No. H8-30054 discloses the configuration in which a transfer entrance guide 200 guiding a recording medium such as papers to a transfer unit transferring an image is attached to a lower unit 300 as a supporting member via a spring 400. In this configuration, an upper unit 500 supporting a photosensitive element 600 moves vertically with respect to the lower unit 300 supporting a transfer roller 700. When the upper unit 500 is moved downward for closing, protrusions 200*a* provided at the transfer entrance guide 200 enter guiding members 300*a* provided at the upper unit 500, and are guided by the guiding members 300*a* to position the upper unit 300.

When the transfer entrance guide is attached to the lower unit via a spring as in the configuration disclosed in Japanese Patent Application Laid-open No. H8-30054, the transfer entrance guide can be freely positioned within the movement range of the spring. In this case, the positioning accuracy of the transfer entrance guide itself is less affected by the positioning accuracy of the lower unit with respect to the upper unit.

However, when the transfer entrance guide is displaceable with respect to the lower unit, the posture of the transfer entrance guide is unstable, which may cause a problem that the transfer entrance guide cannot be stably guided by the guiding members of the upper unit.

Accordingly, in the embodiment, a transfer device capable of guiding stably the transfer entrance guide to the positioning member, and an image forming apparatus including the transfer device. A general configuration of a color laser printer as image forming apparatus in the embodiment is the same as that illustrated in FIGS. 1 and 2 of the first embodiment, and thus descriptions thereof will be omitted.

Configurations for positioning the transfer entrance guide and the secondary transfer roller when the cover is closed will be described with reference to FIGS. 20 to 24.

Figure 20:
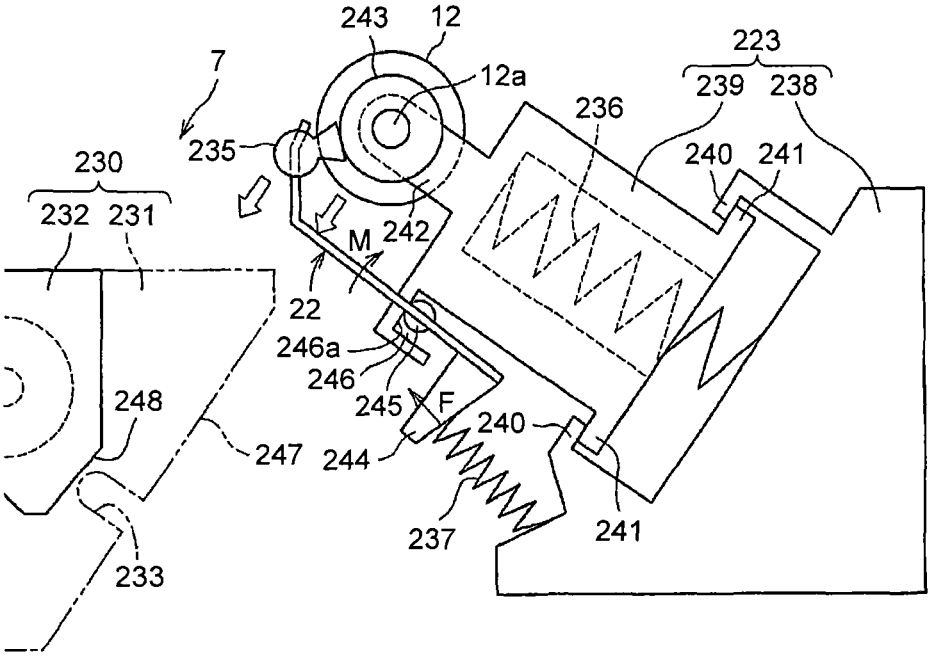
FIG. 20 is a view illustrating a transfer entrance guide and the secondary transfer roller before being guided.
Figure 21:
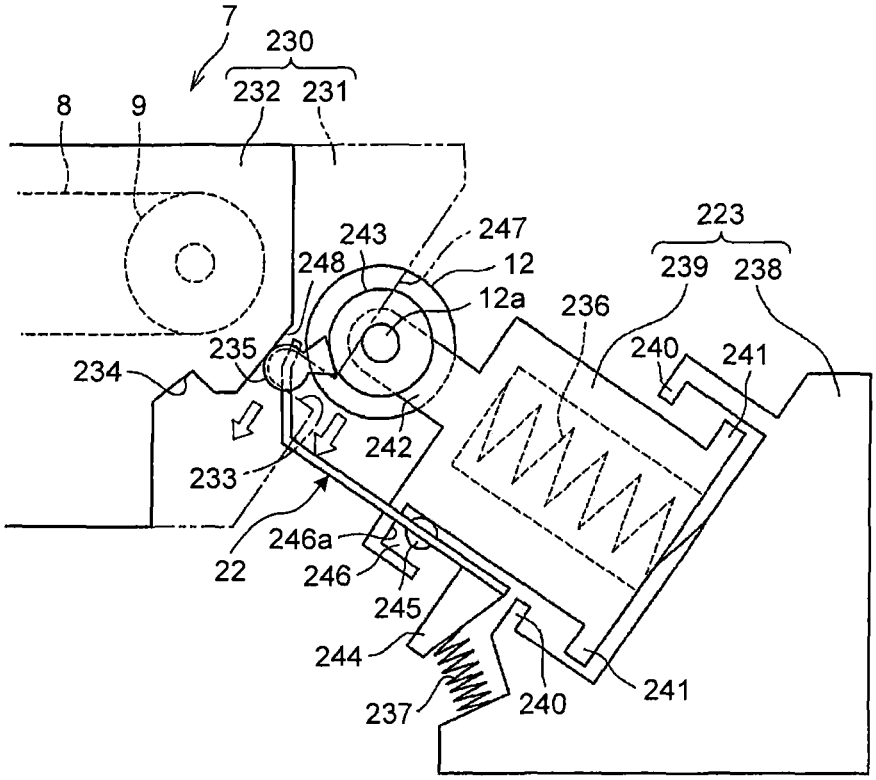
FIG. 21 is a view illustrating the transfer entrance guide and the secondary transfer roller being guided.
Figure 22:
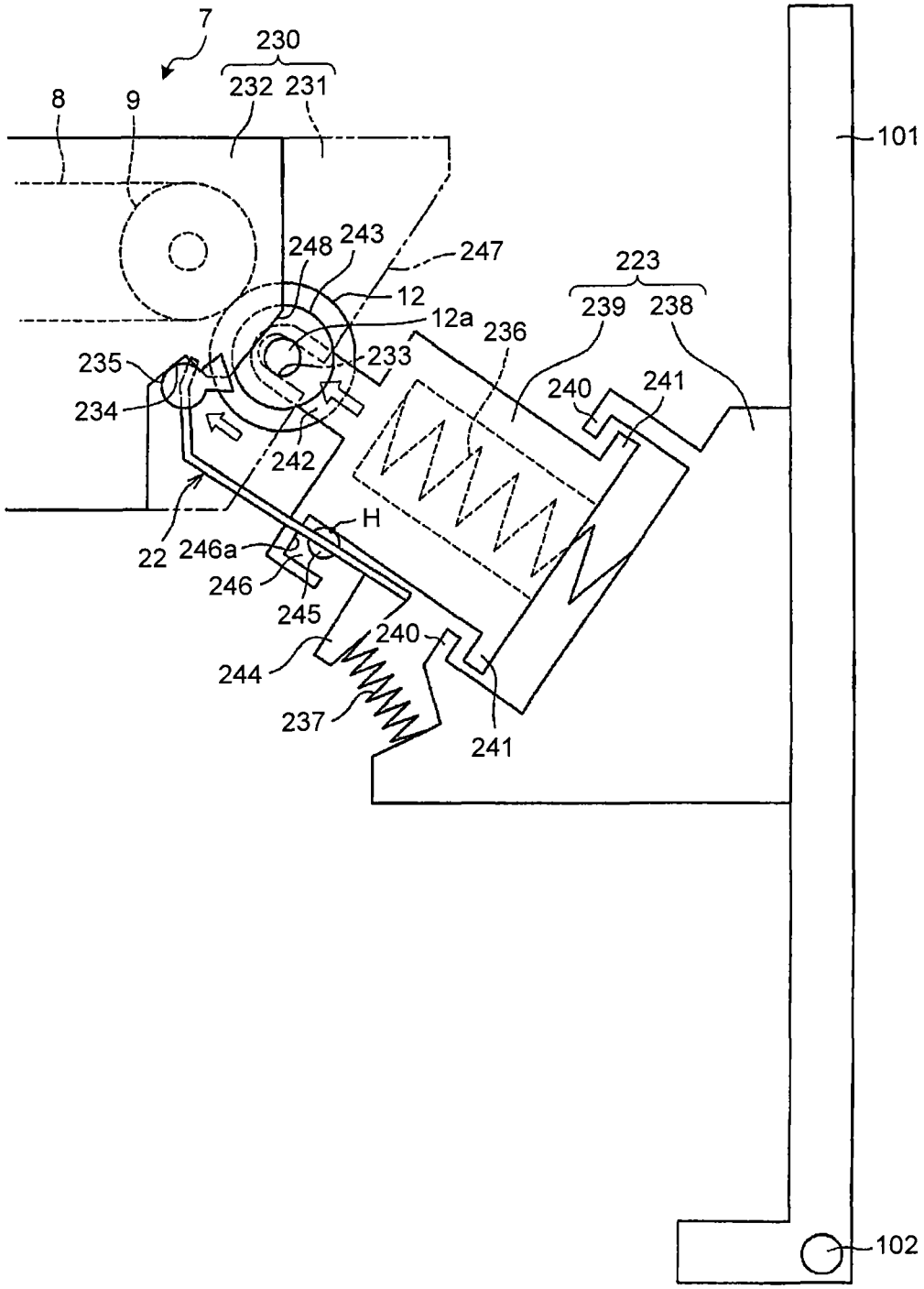
FIG. 22 is a view illustrating the transfer entrance guide and secondary transfer roller after being positioned.
Figure 23:
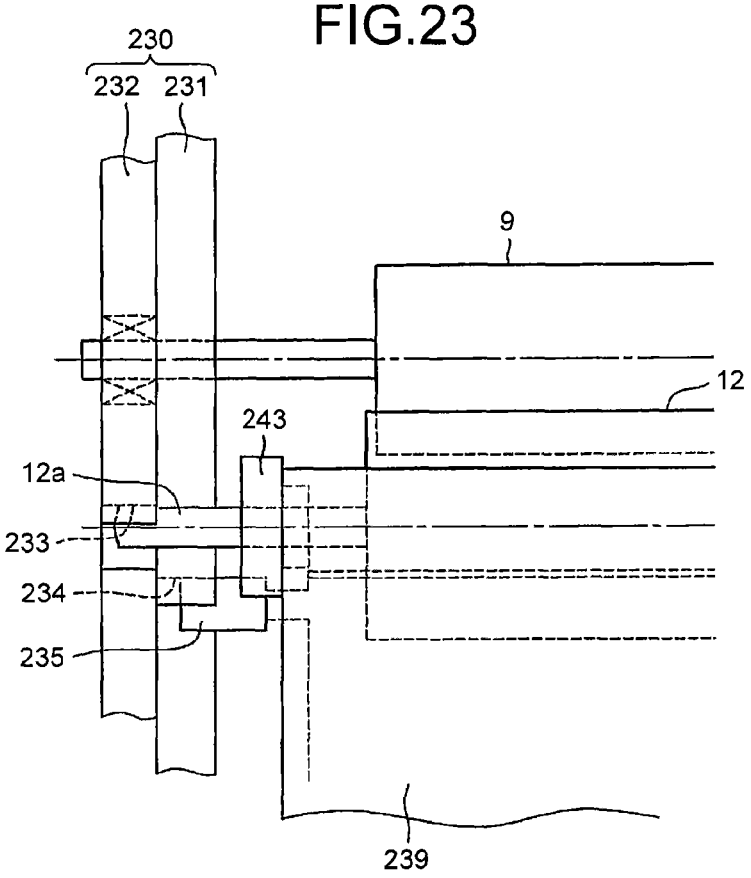
FIG. 23 is a view illustrating FIG. 22 as seen from the right side of FIG. 22.
Figure 24:
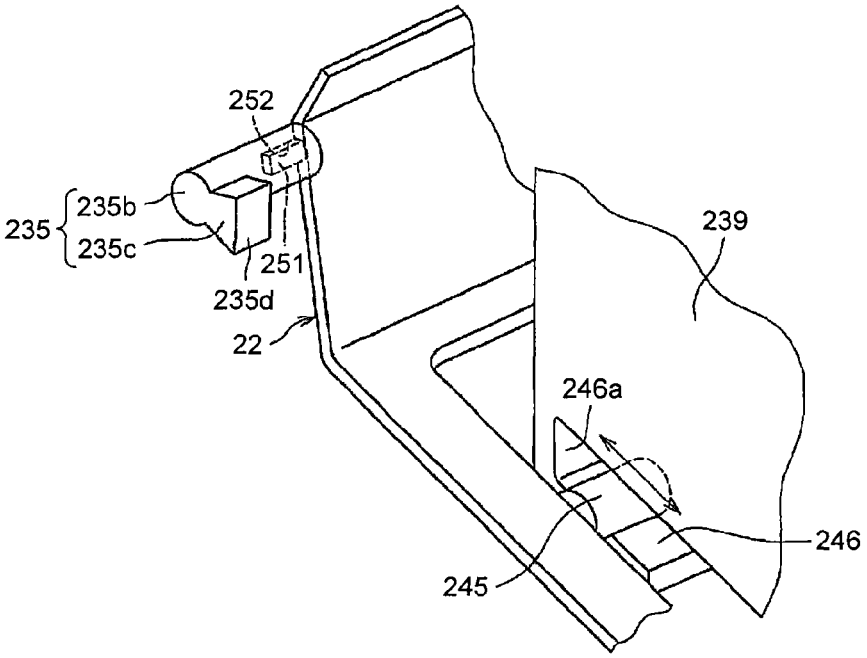
FIG. 24 is an enlarged perspective view of one end side of the transfer entrance guide.

FIG. 20 is a view illustrating the transfer entrance guide and the secondary transfer roller before being guided by guiding members, FIG. 21 is a view illustrating these components being guided, and FIG. 22 is a view illustrating these components after being positioned. FIG. 23 is a side view of FIG. 22 as seen from the right side of FIG. 22. FIG. 24 is an enlarged perspective view of one end unit of the transfer entrance guide. FIGS. 20 and 21 do not illustrate the cover 101. FIGS. 20 to 24 are views illustrating a configuration of one end unit of the secondary transfer roller or the transfer entrance guide, and the configurations for positioning these components are bilaterally symmetric, and thus only one of the two configurations will be described below for simplification.

In FIG. 22, reference numeral 230 denotes a frame arranged on both lateral sides of the intermediate transfer belt 8. The frame 230 supports rotatably the driving roller 9 and the driven roller 10 over which the intermediate transfer belt 8 is extended. The frame 230 includes an outside plate 231 arranged the outside and an inside plate 232 arranged the inside. The outside plate 231 and the inside plate 232 include concave portions as positioning members 233 and 234 positioning the secondary transfer roller 12 and the transfer entrance guide 22. In this arrangement, the concave portion formed in the outside plate 231 is the roller positioning member 233 for positioning the secondary transfer roller 12, and the concave portion formed in the inside plate 232 is the guide positioning member 234 for positioning the transfer entrance guide 22.

In this case, as illustrated in FIG. 22, the rotating shaft 12*a* of the secondary transfer roller 12 is fitted into the roller positioning member 233, and in that state, when the secondary transfer roller 12 abuts the driving roller 9, the secondary transfer roller 12 is positioned. Meanwhile, the transfer entrance guide 22 is positioned when an abutment member 235 provided at a leading end thereof is fitted into the guide positioning member 234.

The outside plate 231 and the inside plate 232 include guiding members (roller guiding member 247 and guide guiding member 248) for guiding the secondary transfer roller 12 and the transfer entrance guide 22 to the respective positioning members 233 and 234 (see FIG. 21). In the embodiment, the secondary transfer roller 12 is guided when the rotating shaft 12*a* of the secondary transfer roller 12 abuts the roller guiding member 247 provided on the outside plate 231. Meanwhile, the transfer entrance guide 22 is guided when the abutment member 235 abuts the guide guiding member 248 provided on the inside plate 232.

A supporting member 223 supporting the secondary transfer roller 12 and the transfer entrance guide 22 includes a fixed supporting member 238 fixed to the inner surface of the cover 101 and a movable supporting member 239 movable with respect to the fixed supporting member 238. The secondary transfer roller 12 is supported by the movable supporting member 239. Specifically, a pair of arms 242 extending from the movable supporting member 239 includes shaft bearings 243, respectively. The both ends of the rotating shaft 12*a* of the secondary transfer roller 12 are rotatably inserted into the respective shaft bearings 243. The movable supporting member 239 is attached to the fixed supporting member 238 via a roller pressing spring 236 as an elastic member. Accordingly, the secondary transfer roller 12 is supported in a manner displaceable to some extent with respect to the fixed supporting member 238 or the cover 101.

The roller pressing spring 236 in the embodiment is a compression coil spring. The movable supporting member 239 and the secondary transfer roller 12 supported by the movable supporting member 239 are biased by the roller pressing spring 236 in the direction of separating from the cover 101. The movable supporting member 239 and the fixed supporting member 238 are provided with control units 240 and 241, respectively, to, by abutment with each other, control a specific amount or more of protrusion of the movable supporting member 239 with respect to the fixed supporting member 238 against the biasing force of the roller pressing spring 236 (see FIG. 20).

The transfer entrance guide 22 is attached to the fixed supporting member 238 via a guide pressing spring 237 as an elastic member. Thus, as with the secondary transfer roller 12, the transfer entrance guide 22 is supported so as to be displaceable to some extent with respect to the fixed supporting member 238 or the cover 101. In the embodiment, the guide pressing spring 237 is a compression coil spring, and the transfer entrance guide 22 is subject to a pressing force of the guide pressing spring 237 at a receiving unit 244 provided at a base unit thereof. Accordingly, as with the secondary transfer roller 12, the transfer entrance guide 22 is biased in the direction of separating from the cover 101. The guide pressing spring 237 may not be a compression coil spring but may be an extension coil spring, torsion spring, or the like.

The transfer entrance guide 22 is provided with a stopper 245 to abut part of the movable supporting member 239 (an opposed member different from the transfer entrance guide 22) to control a specific amount or more of protrusion of the transfer entrance guide 22 with respect to the fixed supporting member 238 against the biasing force of the guide pressing spring 237 (see FIG. 20).

Specifically, as illustrated in FIG. 24, the stopper 245 is formed by a cylindrical protrusion protruding from the transfer entrance guide 22 toward the movable supporting member 239. Meanwhile, the movable supporting member 239 is provided with a groove-shaped insertion member 246 into which the stopper 245 is inserted. The stopper 245 is movable along the insertion member 246, which allows the transfer entrance guide 22 to move back and forth with respect to the fixed supporting member 238. However, when the stopper 245 abuts a control surface 246*a* (opposed to the biasing force of the guide pressing spring 237) of the insertion member 246, a specific amount or more of protrusion of the transfer entrance guide 22 with respect to the fixed supporting member 238 is controlled. While the stopper 245 is in abutment with the control surface 246*a*, the transfer entrance guide 22 is held by the guide guiding member 248 at a position where the transfer entrance guide 22 is capable of being guided.

In the embodiment, the abutment member 235 is formed separately from the transfer entrance guide 22. As illustrated in FIG. 24, the abutment member 235 is attached to the transfer entrance guide 22 by inserting a convex portion 251 provided at a lateral end unit of the transfer entrance guide 22 into a hole 252 of the abutment member 235.

Figure 35:
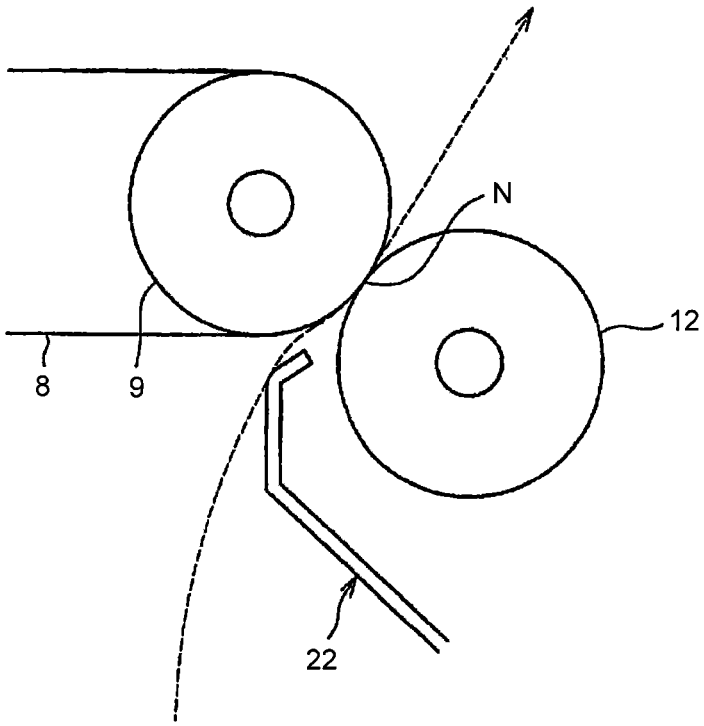
FIG. 35 is a view illustrating a conveying path of paper guided by the transfer entrance guide.

FIG. 35 illustrates a conveying path of paper guided by the positioned transfer entrance guide 22 with a dotted line. In the embodiment, the paper is guided to come into abutment with the intermediate transfer belt 8 near a secondary transfer unit (secondary transfer nip) N on the upstream side in the conveying direction. The paper is guided in the foregoing conveying path to cause the paper to start to abut the intermediate transfer belt 8 near the secondary transfer unit N on the upstream side in the conveying direction where toner on the intermediate transfer belt 8 may be dispersed under influence of a transfer electric field, thereby achieving favorable image transfer. Accordingly, the transfer entrance guide 22 needs to be positioned with accuracy.

However, in general, when the transfer entrance guide 22 and the secondary transfer roller 12 are supported by the same supporting member, there is a problem that the position of the transfer entrance guide 22 may be changed under influence of fluctuations in the position of the secondary transfer roller 12 during paper feeding to the secondary transfer unit. Specifically, when the paper enters into the secondary transfer unit, the secondary transfer roller 12 separates from the intermediate transfer belt 8 by the thickness of the paper, the position of the transfer entrance guide 22 fluctuates under influence of the separation. As the position of the transfer entrance guide 22 fluctuates, the conveying path of the guided paper changes, which may lead to deterioration of image quality.

In contrast to this, in the embodiment, the transfer entrance guide 22 is configured to be less susceptible to influence of fluctuations in the position of the secondary transfer roller 12 during paper feeding. Specifically, as illustrated in FIG. 22, while the transfer entrance guide 22 is positioned, the stopper 245 of the transfer entrance guide 22 is separated from the control surface 246*a* of the movable supporting member 239. That is, when the stopper 245 and the control surface 246*a* are separated from each other in the direction in which the secondary transfer roller 12 fluctuates in position during paper feeding (the direction of the thickness of the paper), even when the movable supporting member 239 fluctuates in position according to fluctuation in the position of the secondary transfer roller 12, it is possible to suppress the following of the movable supporting member 239 by the transfer entrance guide 22.

As illustrated in FIG. 22, while the transfer entrance guide 22 is positioned, the stopper 245 is in abutment with the movable supporting member 239 at a place indicated with H in the drawing. In the embodiment, the abutment place H is set distant from the abutment member 235. Specifically, the abutment place H is set distant from the abutment member 235 by providing the stopper 245 closer to the base unit of the transfer entrance guide 22. Accordingly, even when the movable supporting member 239 is displaced, it is possible to reduce the amount of displacement of the movable supporting member 239 in the direction of rotating with respect to the abutment member 235 because the abutment place H is distant from the positioned abutment member 235.

Figure 25:
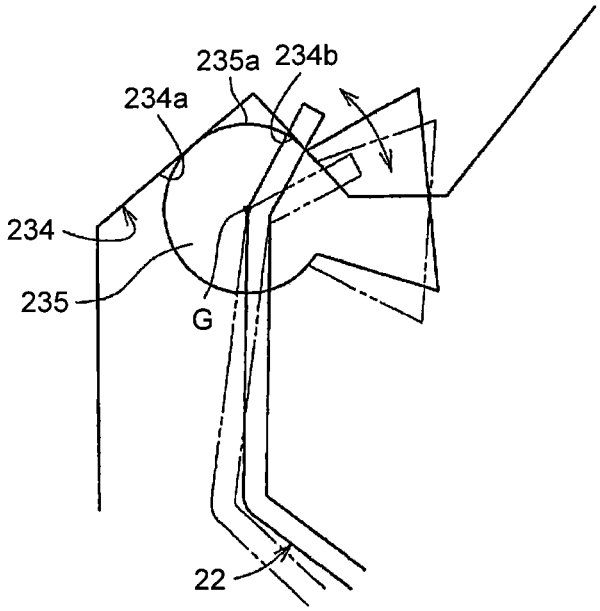
FIG. 25 is an enlarged view of the state in which an abutment member is fitted into a guide positioning member.

FIG. 25 is an enlarged view of the state in which the abutment member is fitted into the guide positioning member.

As illustrated in FIG. 25, the transfer entrance guide 22 is positioned by bringing an arc-shaped outer peripheral surface 235*a* of the abutment member 235 into abutment with two sides 234*a* and 234*b* arranged in a triangle shape of the guide positioning member 234. In this state, when the movable supporting member 239 is displaced, the transfer entrance guide 22 rotates with respect to the center of the arc-shaped outer peripheral surface 235*a* of the abutment member 235 as illustrated with two-dot chain lines in FIG. 25. At that time, since center G of the arch-shaped outer peripheral surface 235*a* does not change in position, it is preferred to provide a contact unit that contacts with the paper in the transfer entrance guide 22 at or near the center of the arch-shaped outer peripheral surface 235*a*. When the contact unit that contacts with the paper is provided at that position, the contact unit hardly changes in position even with displacement of the movable supporting member 239, thereby achieving further improvement of guiding accuracy of paper.

Next, guiding operations of the transfer entrance guide 22 and the secondary transfer roller 12 with closing of the cover 101 will be described with reference to FIGS. 20 to 22.

First, as illustrated in FIG. 20, before the transfer entrance guide 22 and the secondary transfer roller 12 are guided by the respective guiding members 247 and 248, the abutment member 235 at the leading end side of the transfer entrance guide 22 is held in abutment with the shaft bearing 243 of the secondary transfer roller 12. Specifically, in the state illustrated in FIG. 20, the stopper 245 of the transfer entrance guide 22 is held at a predetermined position in abutment with the control surface 246*a* of the movable supporting member 239. When the transfer entrance guide 22 rotates around the stopper 245 clockwise in the drawing, the abutment member 235 abuts the shaft bearing 243. At that time, rotation moment M is generated at the transfer entrance guide 22 as direction F of the pressing force of the guide pressing spring 237 applied to the transfer entrance guide 22 is shifted with respect to the stopper 245 as rotation center. Accordingly, while the abutment member 235 and the shaft bearing 243 are in abutment with each other, the transfer entrance guide 22 and the secondary transfer roller 12 move closer to the guiding members 247 and 248, respectively.

As illustrated in FIG. 21, when the rotating shaft 12*a* of the secondary transfer roller 12 abuts the roller guiding member 247 and the abutment member 235 of the transfer entrance guide 22 abuts the guide guiding member 248, the secondary transfer roller 12 and the transfer entrance guide 22 are guided to the positioning members 233 and 234, respectively. At that time, as described in the foregoing, the abutment member 235 and the shaft bearing 243 are guided in abutment with each other. In addition, when the rotating shaft 12*a* of the secondary transfer roller 12 abuts the roller guiding member 247, the secondary transfer roller 12 is pressed in the direction of coming closer to the fixed supporting member 238, and the respective control units 240 and 241 of the movable supporting member 239 and the fixed supporting member 238 are separated from each other. Further, when the abutment member 235 abuts the guide guiding member 248, the transfer entrance guide 22 is also pressed in the direction of coming closer to the fixed supporting member 238, and the stopper 245 is separated from the control surface 246*a*.

After that, when the rotating shaft 12*a* of the secondary transfer roller 12 reaches the roller positioning member 233, as illustrated in FIG. 22, the rotating shaft 12*a* is pressed into the concave portion constituting the roller positioning member 233 by resilience of the roller pressing spring 236. As a result, the secondary transfer roller 12 abuts the driving roller 9 (via the intermediate transfer belt 8), and thus the secondary transfer roller 12 is positioned.

At almost the same time, the abutment member 235 of the transfer entrance guide 22 reaches the guide positioning member 234, as illustrated in FIG. 22, the abutment member 235 is pressed into the guide positioning member 234 by resilience of the guide pressing spring 237. Accordingly, the transfer entrance guide 22 is positioned with a leading end located at a predetermined position near the secondary transfer unit.

In reverse, although detailed descriptions are omitted, when the cover 101 is opened, the secondary transfer roller 12 and the transfer entrance guide 22 are accordingly separated from the respective positioning members 233 and 234 and guided along the respective guiding members 247 and 248 in the direction opposite to that at the closing of the cover 101.

As described in the foregoing, in the configuration of the embodiment, when the transfer entrance guide 22 is guided to the guide positioning member 234, the abutment member 235 is brought into abutment with the shaft bearing 243 of the secondary transfer roller 12, which makes it possible to press the transfer entrance guide 22 while supporting the same by the shaft bearing 243. Accordingly, it is possible to stabilize the posture of the abutment member 235 until coming into abutment with the guide guiding member 248 and move smoothly the abutment member 235 guided by the guide guiding member 248. Thus, according to the configuration of the embodiment, even when the transfer entrance guide 22 is supported so as to be capable of displacement, the transfer entrance guide 22 can be stably guided to the guide positioning member 234.

In particular, in the configuration in which the transfer entrance guide 22 is biased toward the guiding surface of the guide guiding member 248 as in the embodiment, there is a possibility that the guiding of the transfer entrance guide 22 is hindered by the biasing force. Therefore, it can be expected that applying the present invention to the foregoing configuration will produce a great advantage.

In the embodiment, as illustrated in FIG. 24, the abutment member 235 includes a circular cylindrical portion 235*b* and a trapezoidal portion 235*c* provided at one end of the circular cylindrical portion 235*b*. The abutment member 235 abuts the shaft bearing 243 at a planar surface portion 235*d* of the trapezoidal portion 235*c*. Accordingly, when the abutment member 235 is brought into abutment with the shaft bearing 243 at the planar surface portion 235*d*, it is easier to allow the abutment member 235 to abut the shaft bearing 243 and stabilize the posture of the transfer entrance guide 22 in the abutted state, as compared to the case where the abutment member 235 is brought into abutment with the shaft bearing 243 at the circular cylindrical portion 235*b*.

Figure 26:
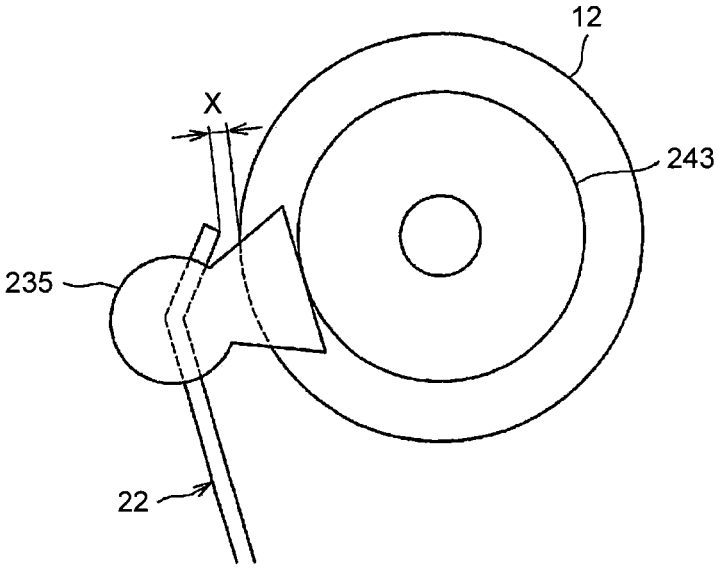
FIG. 26 is an enlarged view of the state in which the abutment member is in abutment with a shaft bearing.

In addition, in the embodiment, while the abutment member 235 is in abutment with the shaft bearing 243 (as illustrated in FIG. 20 and FIG. 21), a gap X intervenes between the leading end of the transfer entrance guide 22 and the roller surface of the secondary transfer roller 12, as illustrated in FIG. 26. Thus, when the leading end of the transfer entrance guide 22 is held in non-contact with the roller surface, it is possible to avoid occurrence of scratches, damage, and the like on the roller surface by contact of the leading end of the transfer entrance guide 22 with the roller surface. This state (in which the leading end of the transfer entrance guide 22 is held in non-contact with the roller surface) is kept at any time even when the cover 101 is fully opened.

Figure 27:
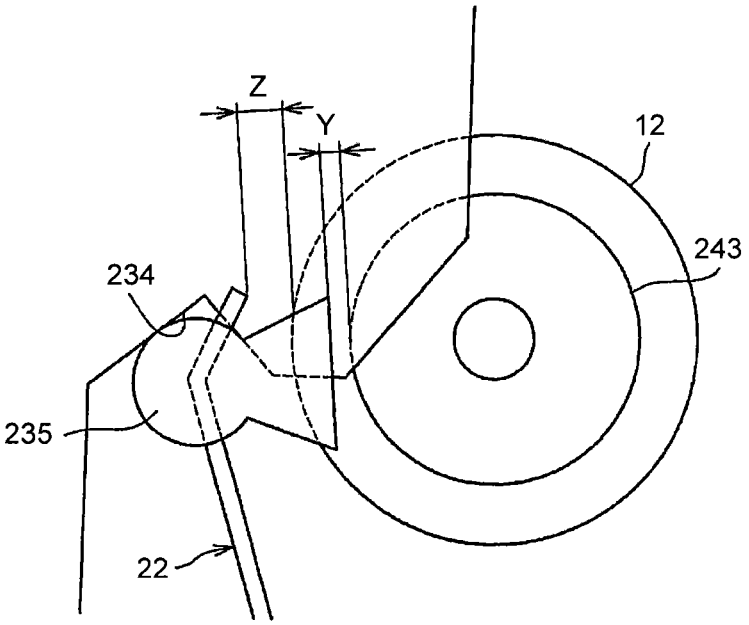
FIG. 27 is an enlarged view of the state in which the transfer entrance guide is positioned.

In the embodiment, while the abutment member 235 is positioned by the guide positioning member 234 (as illustrated in FIG. 22), a gap Y intervenes between the abutment member 235 and the shaft bearing 243 as illustrated in FIG. 27. Thus, when the positioned abutment member 235 is held in non-contact with the shaft bearing 243, it is possible to prevent influence of variations in the position of the shaft bearing 243 on the abutment member 235, thereby achieving improvement in the positioning accuracy of the abutment member 235.

In addition, while the abutment member 235 is positioned by the guide positioning member 234, a gap Z intervenes between the leading end of the transfer entrance guide 22 and the roller surface of the secondary transfer roller 12, as illustrated in FIG. 27. The gap Z is set larger than the gap Y between the abutment member 235 and the shaft bearing 243 (Z>Y). Thus, setting the foregoing relationship between the gap Y and the gap Z makes it possible to prevent the leading end of the transfer entrance guide 22 from contacting the roller surface when the abutment member 235 abuts the shaft bearing 243.

The present invention is not limited to the foregoing embodiment but may be modified in various manners without deviating from the gist of the present invention.

Figure 28:
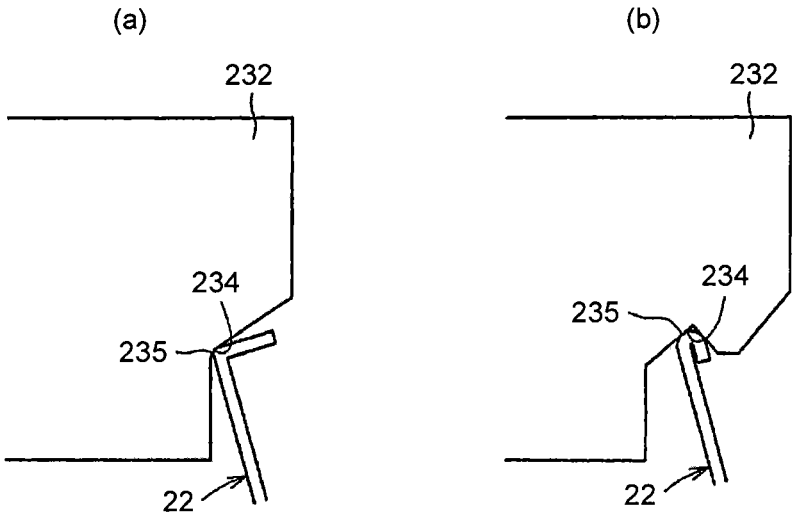
FIG. 28 is a view illustrating examples in which the contact unit is formed by part of the transfer entrance guide.

In the foregoing embodiment, the abutment member 235 is formed separately from the transfer entrance guide 22 (see FIG. 24). Alternatively, the abutment member 235 may be formed by part of the transfer entrance guide 22 as illustrated in FIGS. 28(*a*) and 28(*b*), for example. In the example illustrated in FIG. 28(*a*), the leading end side of the transfer entrance guide 22 is bent in an L shape, and the bent portion is in abutment with the guide positioning member 234, as the abutment member 235. In addition, in the example illustrated in FIG. 28(*b*), the leading end side of the transfer entrance guide 22 is bent in a U shape, and the bent portion is in abutment with the guide positioning member 234, as the abutment member 235.

As described in the foregoing, when the abutment member 235 is formed by part of the transfer entrance guide 22, it is possible to reduce parts count as compared to the case where the abutment member 235 is formed as a separate component. Conversely, when the abutment member 235 is formed as a separate component, the abutment member 235 and the transfer entrance guide 22 can be advantageously formed by different materials. Further, the shape of the transfer entrance guide 22 itself can be simplified, which makes it possible to avoid increases in cost and placement space resulting from complication of the shape of the transfer entrance guide 22.

Figure 29:
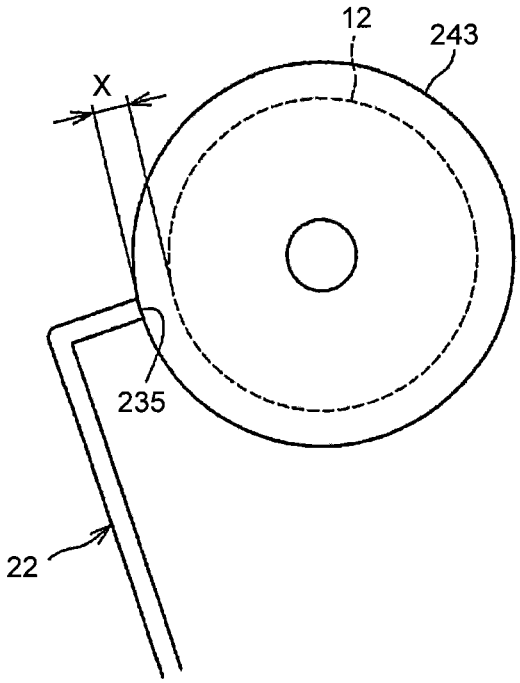
FIG. 29 is an enlarged view of the state in which the transfer entrance guide is in abutment with the shaft bearing.

As illustrated in FIG. 29, the transfer entrance guide 22 itself may be in abutment with the shaft bearing 243 of the secondary transfer roller 12. In this example, although the leading end of the transfer entrance guide 22 as the abutment member 235 is in abutment with the shaft bearing 243, the outer diameter of the shaft bearing 243 is made larger than the other diameter of the secondary transfer roller 12, thereby to avoid the leading end of the transfer entrance guide 22 from contacting the roller surface of the secondary transfer roller 12.

Figure 30:
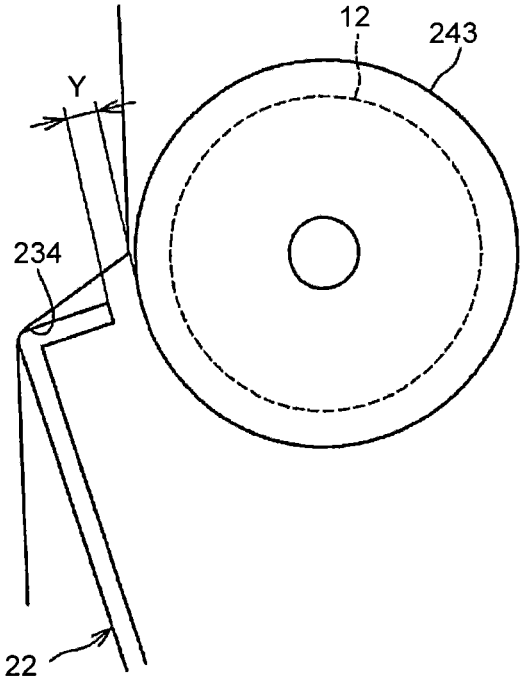
FIG. 30 is an enlarged view of the state in which the transfer entrance guide is positioned.

Also in the example illustrated in FIG. 29, while the transfer entrance guide 22 is positioned by the guide positioning member 234, the leading end of the transfer entrance guide 22 is desirably separated from the shaft bearing 243 and in non-contact with the shaft bearing 243, as illustrated in FIG. 30. This makes it possible to improve the positioning accuracy of the transfer entrance guide 22, as in the foregoing embodiment.

Figure 31:
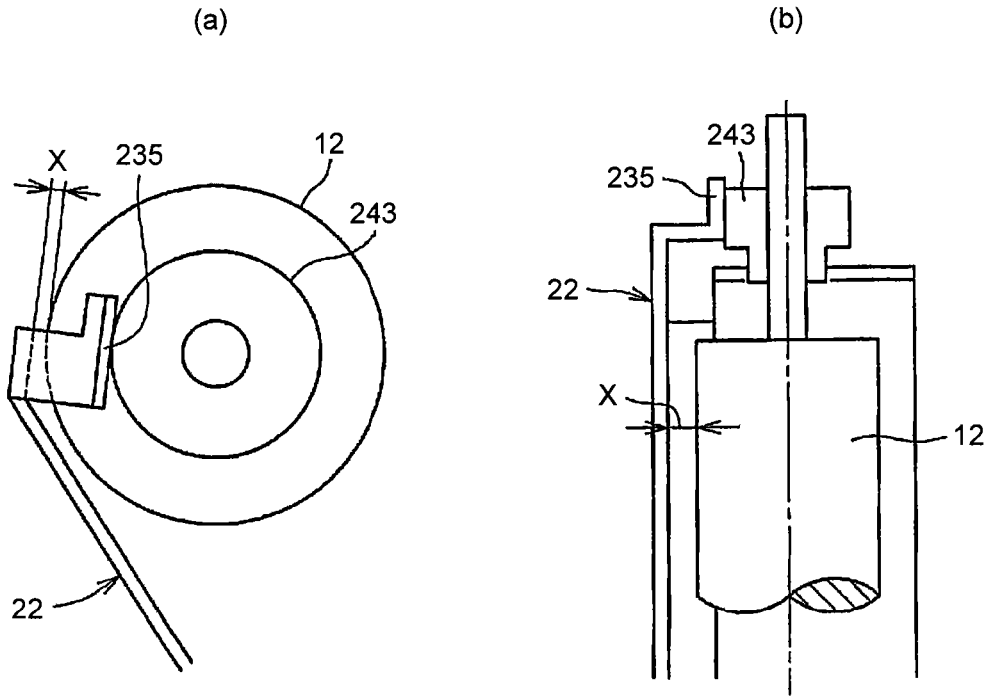
FIG. 31 is a view illustrating another example in which the abutment member is formed by part of the transfer entrance guide, and an enlarged view of the state in which the abutment member is in abutment with the shaft bearing.

As illustrated in FIGS. 31(*a*) and 31(*b*), the leading end of the transfer entrance guide 22 may include a portion extended toward the shaft bearing 243, which is the abutment member 235 in abutment with the shaft bearing 243. Also in this example, while the abutment member 235 is in abutment with the shaft bearing 243, the gap X desirably intervenes between the leading end of the transfer entrance guide 22 and the roller surface of the secondary transfer roller 12.

Figure 32:
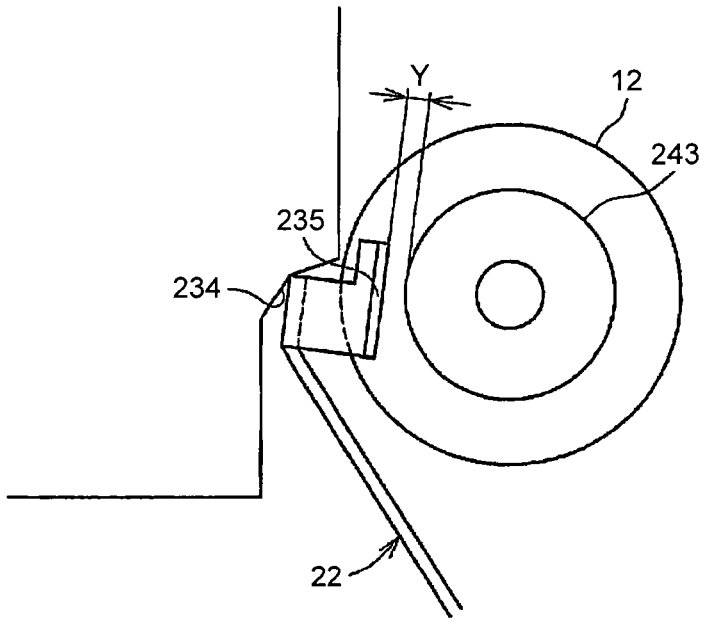
FIG. 32 is an enlarged view of the state in which the transfer entrance guide is positioned.

In the example illustrated in FIG. 31, while the transfer entrance guide 22 is positioned by the guide positioning member 234, the abutment member 235 can be separated from the shaft bearing 243 as illustrated in FIG. 32 to improve the positioning accuracy of the transfer entrance guide 22 as in the foregoing examples.

In the foregoing embodiments, the shaft bearing 243 is used as a guiding auxiliary member to assist the guidance by pressing the transfer entrance guide 22 in the direction of guiding toward the guide positioning member 234. However, the configuration of the present invention is not limited to this.

Figure 33:
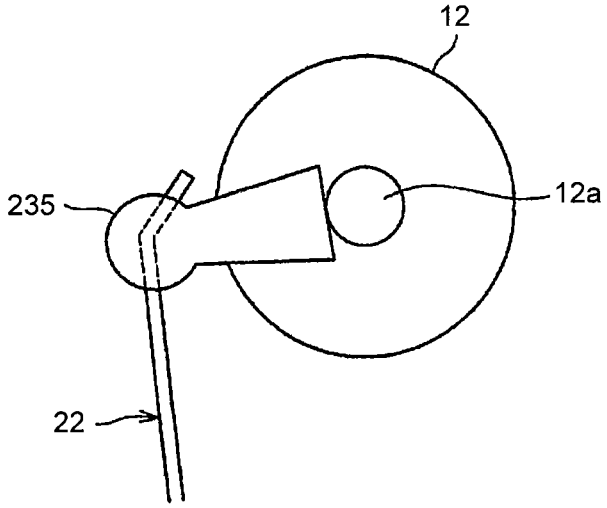
FIG. 33 is a view illustrating an example in which the rotating shaft of the secondary transfer roller is in abutment with the abutment member.
Figure 34:
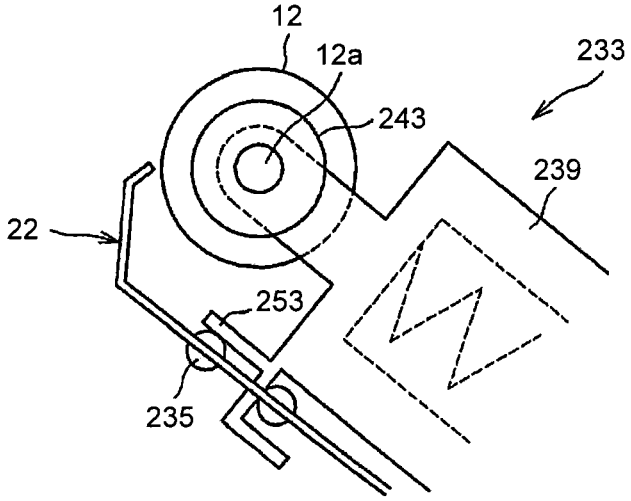
FIG. 34 is a view illustrating an example in which part of a supporting member is in abutment with the abutment member.

For example, as illustrated in FIG. 33, the rotating shaft 12*a* of the secondary transfer roller 12 may be in abutment with the abutment member 235 to function as a guiding auxiliary member. Otherwise, as illustrate in FIG. 34, the supporting member 223 (the movable supporting member 239 in this example) may be provided with a protrusion 253 so that the abutment member 235 is pressed by the protrusion 253 to allow the supporting member 223 to function as a guiding auxiliary ember. When the rotating shaft 12*a* is used as a guiding auxiliary member, the configuration may be simplified. However, when the rotating shaft 12*a* is thin, it is difficult to make abutment between the rotating shaft 12*a* and the abutment member 235, and thus using the shaft bearing 243 or the supporting member 223 as a guiding auxiliary member makes it easier to bring the rotating shaft 12*a* into abutment with the abutment member 235.

The present invention can be applied to the configuration in which the transfer unit (primary transfer unit) transferring an image on the photosensitive element 600 directly to the paper, and the configuration in which the transfer entrance guide 200 does not come into contact with or separate from the guide guiding member (guiding member 300*a*) but the guide guiding member comes into contact with or separates from the transfer entrance guide 200, as illustrated in FIG. 36. The image forming apparatus to which the present invention can be applied is not limited to a color laser printer as illustrated in FIG. 1 but may be any other printer, copying machine, or MFP including these devices, or the like.

According to the present invention, on closing of the cover, the unit can be effectively moved by the protrusion in the direction of attachment. Accordingly, it is possible to attach the unit to the attachment unit on closing of the cover, thereby suppressing occurrence of improper attachment of the unit.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus, comprising:

a main body;

a cover configured to be provided so as to be capable of being opened and closed with respect to the main body;

an attachment unit configured to be provided on the cover;

a unit configured to be attached to the attachment unit;

a positioning member configured to, on closing of the cover, position the unit with respect to a member attached to the main body or the main body;

a guiding member configured to guide the unit to the positioning member;

a protrusion configured to be provided at the guiding member to protrude in an attaching direction of the unit; and a lock member at which the unit attached to the attachment unit is hooked and locked on a hook of the attachment unit.

2. The image forming apparatus according to claim 1, wherein the protrusion is provided between a start point at which, when the cover is closed, the unit starts to abut the main body or the member attached to the main body, and the positioning member.

3. The image forming apparatus according to claim 1, wherein the protrusion includes a guide surface exerting a force on the unit, upon abutment with the unit, to allow the unit to be able to be attached to the attachment unit.

4. The image forming apparatus according to claim 3, wherein the protrusion includes a first guide surface provided upstream of a direction of guiding the unit to the positioning member and a second guide surface provided downstream of the first guide surface and is set at an angle different from that of the first guide surface, and at least the second guide surface is set at an angle at which a force acts on the unit to allow the unit to be able to be attached to the attachment unit upon abutment with the unit.

5. The image forming apparatus according to claim 1, wherein an abutment force with which the unit abuts the guiding member acts in a direction inclined toward the positioning member with respect to a direction orthogonal to the guiding member.

6. The image forming apparatus according to claim 5, wherein, when it is assumed that an angle formed by the direction of the abutment force with which the unit abuts the guiding member and the direction orthogonal to the guiding member is designated as $\theta$ and the friction coefficient between the unit and the guiding member is designated as $\mu$, $\tan\theta > \mu$ is held.

7. The image forming apparatus according to claim 6, wherein the unit is configured to be displaceable with respect to the cover, and when the cover is closed, the unit is displaced by abutment with the guiding member to increase the angle $\theta$.

8. The image forming apparatus according to claim 5, wherein the cover is provided with an elastic member to bias the unit toward the positioning member and the guiding member, and a movement locus of the unit abutment member abutting the guiding member and guided to the positioning member and a movement locus of the cover being closed, come closer to each other in the direction of closing the cover.

9. The image forming apparatus according to claim 1, wherein the unit comprises an insertion member that is inserted into an insertion hole provided in the attachment unit.

10. The image forming apparatus according to claim 1, further comprising an elastic member configured to press the unit toward the positioning member and the guiding member, wherein the attaching direction of the unit and the pressing direction of the elastic member when positioning the unit at the positioning member intersect each other.

11. An image forming apparatus, comprising:

a main body including a frame;

a cover including a hole and configured to be opened and closed with respect to the main body;

a transfer roller supporter including a pin and configured to support a transfer roller and to be attached to the cover by inserting the pin into the hole in an attaching direction;

a groove provided on the frame and configured to, on closing of the cover, position a shaft of the transfer roller with respect to the frame;

a guide provided on the frame and configured to guide the shaft of the transfer roller to the groove; and a protrusion provided on the guide and protruding in the attaching direction.

12. The image forming apparatus according to claim 11, wherein the transfer roller supporter includes a claw and the cover includes a hook on which the claw is hooked when the pin is inserted into the hole.

13. A transfer device, comprising:

a transfer unit configured to transfer an image to a recording medium;

a transfer entrance guide configured to be switchable between a guiding position at which to guide the recording medium to the transfer unit and an evacuation position being relatively evacuated from the guiding position;

a supporting member that supports the transfer entrance guide in a displaceable manner;

a guide positioning member configured to guide the transfer entrance guide at the guiding position; and a guide guiding member configured to guide the transfer entrance guide to the guide positioning member, wherein the transfer device further comprises a guiding auxiliary member, when the transfer entrance guide is guided to the guide positioning member along the guide guiding member, abuts an abutment member of the transfer entrance guide and presses the transfer entrance guide in a guiding direction toward the guide positioning member.

14. The transfer device according to claim 13, wherein an elastic member is provided to bias the transfer entrance guide toward a guide surface of the guide guiding member.

15. The transfer device according to claim 14, wherein the transfer entrance guide is provided with a stopper that abuts another member different from the transfer entrance guide to control displacement of the transfer entrance guide against a biasing force of the elastic member and hold the transfer entrance guide at a position capable of guiding the transfer entrance guide by the guide guiding member.

16. The transfer device according to claim 15, wherein, while the stopper is in abutment with the other member to control displacement of the transfer entrance guide, the transfer entrance guide is rotated around the stopper by the biasing force of the elastic member to bring the abutment member into abutment with the guiding auxiliary member.

17. The transfer device according to claim 13, wherein, while the transfer entrance guide is positioned by the guide positioning member, the guiding auxiliary member is in non-contact with the abutment member of the transfer entrance guide.

18. The transfer device according to claim 13, wherein the supporting member is provided with one of transfer members in a pair constituting the transfer unit by abutment with each other, and while the guiding auxiliary member and the abutment member are in abutment with each other, the transfer entrance guide is in non-contact with the transfer member.

19. The transfer device according to claim 18, wherein the transfer member is a transfer roller rotatably supported by the supporting member via a shaft bearing, and the guiding auxiliary member is a shaft bearing for the transfer roller.

20. The transfer device according to claim 18, wherein the transfer member is a transfer roller rotatably supported by the supporting member via a shaft bearing, and the guiding auxiliary member is a rotating shaft of the transfer roller.

21. The image forming apparatus according to claim 1, wherein the unit is removable from the attachment unit.

* * * * *